US007478619B2

(12) United States Patent
Patrono

(10) Patent No.: US 7,478,619 B2
(45) Date of Patent: Jan. 20, 2009

(54) ROTARY ENGINE FOR MOTOR VEHICLES WITH VERY LOW CONSUMPTION AND POLLUTION RATE

(76) Inventor: Vittorio Patrono, Via Pietro Nenni, 14, Belgioioso (IT) 27011

( * ) Notice: Subject to any disclaimer, the term of this patent is extended or adjusted under 35 U.S.C. 154(b) by 0 days.

(21) Appl. No.: 10/552,151

(22) PCT Filed: Apr. 8, 2003

(86) PCT No.: PCT/IT03/00213

§ 371 (c)(1),
(2), (4) Date: Oct. 7, 2005

(87) PCT Pub. No.: WO2004/090289

PCT Pub. Date: Oct. 21, 2004

(65) Prior Publication Data

US 2006/0196465 A1 Sep. 7, 2006

(51) Int. Cl.

| | |
|---|---|
| ***F02B 53/04*** | (2006.01) |
| ***F02B 53/00*** | (2006.01) |
| ***F02B 75/00*** | (2006.01) |
| ***F01C 1/348*** | (2006.01) |
| ***F01C 1/344*** | (2006.01) |

(52) U.S. Cl. ..... 123/241; 123/243; 418/16; 418/19; 418/177; 418/166

(58) Field of Classification Search ..... 123/243, 123/240, 241; 418/28, 26, 6, 260, 23, 86, 418/16, 19, 177, 166; 417/295; *F04C 18/344; F02B 75/00; F01C 1/348, 1/344*

See application file for complete search history.

(56) References Cited

U.S. PATENT DOCUMENTS

| | | | | |
|---|---|---|---|---|
| 1,497,741 | A * | 6/1924 | Schneider | 60/465 |
| 1,536,245 | A * | 5/1925 | Thelin | 123/245 |
| RE17,326 | E * | 6/1929 | Bullard | 123/241 |
| 2,965,288 | A * | 12/1960 | Butler | 417/295 |
| 3,139,835 | A * | 7/1964 | Wilkinson | 418/9 |

(Continued)

FOREIGN PATENT DOCUMENTS

| | | |
|---|---|---|
| FR | 1418535 | * 11/1965 |

(Continued)

OTHER PUBLICATIONS

Translation of Patent No. FR 2324870 A.*

*Primary Examiner*—Thai-Ba Trieu
(74) *Attorney, Agent, or Firm*—Shoemaker and Mattare

(57) ABSTRACT

An internal combustion rotary engine is described, adapted to be used both for motor vehicles and ground machines (alternators, compressors, pumps and the like) or water craft or any type. The used fuels are the same of the presently used reciprocating engines. This engine comprises two rotors one inside the other, rotating in the same direction and at the same number of revolutions on two non concentric axes. The eccentricity between the two axes creates a crescent like chamber divided into four parts by four mobile elements mounted on the internal rotor, said elements being in turn constituted by two bodies that fit continuously to the inner surface of the external rotor thus ensuring the tight seal between the chambers. The efficiency of this motor is more than double of a reciprocating engine of the same displacement, with consequent halving of consumptions and emissions of carbon monoxide and dioxide.

12 Claims, 32 Drawing Sheets

U.S. PATENT DOCUMENTS

| | | | | | |
|---|---|---|---|---|---|
| 3,311,094 | A | * | 3/1967 | Kehl | 123/245 |
| 3,426,735 | A | * | 2/1969 | Kelly | 123/243 |
| 3,437,079 | A | * | 4/1969 | Odawara | 123/243 |
| 3,485,179 | A | * | 12/1969 | Dawes | 418/86 |
| 3,697,203 | A | * | 10/1972 | Butler | 418/173 |
| 3,781,146 | A | * | 12/1973 | Bates | 418/6 |
| 3,913,533 | A | * | 10/1975 | Meaden | 123/242 |
| 3,955,540 | A | * | 5/1976 | Blanchard | 418/260 |
| 4,385,873 | A | * | 5/1983 | Richter | 418/23 |
| 4,902,209 | A | * | 2/1990 | Olson | 418/6 |
| 5,597,295 | A | * | 1/1997 | Pipaloff | 418/6 |
| 5,674,059 | A | * | 10/1997 | Bucur | 418/28 |
| 5,944,493 | A | * | 8/1999 | Albertin et al. | 417/273 |
| 6,776,136 | B1 | * | 8/2004 | Kazempour | 123/243 |
| 2007/0014681 | A1 | * | 1/2007 | Beaudoin | 418/61.2 |

FOREIGN PATENT DOCUMENTS

| | | | | |
|---|---|---|---|---|
| FR | 2324870 | A | * | 5/1977 |
| FR | 2626620 | A1 | * | 8/1989 |
| GB | 534339 | | * | 3/1941 |
| GB | 2322913 | A | * | 9/1998 |
| JP | 58051291 | A | * | 3/1983 |
| KR | 2003005655 | A | * | 1/2003 |

* cited by examiner

AXES SUPPORT DISTRIBUTION SIDE
AXES SUPPORT SUPERCHARGER SIDE
VIEW "C"
VIEW "D"
VIEW "A"
VIEW "B"
"C" PLAN
PLAN "A"
SECTION B–B
SECTION A–A
INTERNAL ROTOR AXE
EXTERNAL ROTOR AXE
10 mm
15°

INTAKE VALVE SECTION
41

INTAKE VALVE
41
aria
air

SECTION C–C
SEE FIG 18
VALVE OPEN
VALVE CLOSED
VIEW "A"
3
8
28
30

VIEW "A"

SECTION "C-C"

SECTION "A-A"

SECTION "B-B"

SECTION "D"
VIEW "B" 45° ROTATED

INTERNAL ROTOR SHAFT

ROTARY ENGINE FOR MOTOR VEHICLES WITH VERY LOW CONSUMPTION AND POLLUTION RATE

FIELD OF THE INVENTION

The field of application of this engine covers all the machines where the reciprocating engine is presently used. Its characteristics concerning consumption and therefore operating costs and more particularly the reduction of the environmental pollution rate, will allow to supplant quickly the piston engines whose efficiency is no more susceptible of great improvements.

BACKGROUND OF THE INVENTION

In order to understand the invention it is sufficient to have a basic knowledge of the operating principles of a reciprocating engine using the Otto cycle, some knowledge of the operation of turbine blades, centrifugal compressors and nozzles of rocket and jet engines.

ANALYSIS OF THE PROBLEM

The problem of pollution from exhaust gases in the big urban areas is treated practically every day by the mass media and measures are often adopted such as circulation with alternate numberplates or total traffic ban and the public opinion is now aware that this problem is the greatest of the problems and the most urgent to be solved.

Indeed the possible solutions proposed by experts and scholars in this field are numerous and almost all of them are based on prototypes that can certainly be made and operated in a laboratory but they cannot be used at all on a large scale and on roads outside town for various reasons.

One proposal concerns the hydrogen motors whose operation does not produce any pollution but at the same time nobody recognizes that this solution is actually impracticable, because it is only a laboratory solution that cannot be applied nowadays on a large scale as required by the urgency of the situation.

Hydrogen that in any case could be used with greater advantages even with the rotary engine of the present invention, is a very dangerous gas that does not lend itself to be transported in tanks on the motor vehicles. In order to keep hydrogen in the gaseous state it is necessary to install on the vehicles very heavy cylinders at very high pressure that would be an extremely serious danger in case of accidents.

When disasters due to the explosion of some cylinders of this type would occur, such a solution would be abandoned realizing to have spent enormous amounts of money for a distribution network destined to be abandoned.

However this solution is impracticable mainly for economic reasons and nothing can be done today if there are no real advantages. The hydrogen obtained in the refinery production cycles is just sufficient for their operation, being used for removal of sulphur from gasoline and gas-oil, and moreover the sulphur removal from fuel oils was also started with an exponential increase of the hydrogen demand, probably requiring more hydrogen than that obtainable in the normal working cycles and it will certainly not be convenient to build specific plants to make hydrogen from petroleum, as the waste product would be coal in huge quantities.

Hydrogen could be obtained by separation from the water molecule in specific plants whose operation would always and in any case generate pollution in another place with an energy consumption even higher than the energy obtained combining again oxygen with hydrogen in the combustion engine.

In order to operate these plants, one could certainly use instead of petroleum derivatives the atomic energy to split hydrogen from oxygen, but this solution would be worse than the problem. Therefore one would always obtain only a shift of the problem in other places instead of the solution or even an amplification of the problem elsewhere.

Then one could choose to use electric vehicles, but to operate them one should produce millions and millions of batteries thus generating the problem of disposing of the used batteries. However, if the world is already polluted by the small cells presently used, one can easily imagine what could occur with millions of batteries of big size, that could be even found on the road edge thrown away by irresponsible persons, polluting the soil and the water table with lead or other worse poisonous metal.

We would not destroy the earth with carbon oxide and dioxide but with metals, acids and other poisonous substances, not leaving out the fact that for the road and town distribution of batteries for motor vehicles it would be necessary to create anew presently inexistent network and every family would be obliged to buy a car for town circulation and another one for longer trips and where these additional cars could be parked when there are no sufficient parking spaces for the existing cars? And taking for granted that the mankind accepts this solution, how much time would be required for the families to reach such a sufficiently high income to be able to buy two cars, one for urban traffic and another for travelling. Moreover even if this would be possible in the developed countries, the rest of the world would go on polluting so that the general result would be extremely low.

All the above mentioned solutions would solve the problem only locally just as some motorists solve the problem of cleaning their vehicle throwing away waste from the window. Therefore this solution should be immediate and global and not a local solution shifting the problem from one place to another.

OBJECT OF THE INVENTION

A great result would be obtained if the emissions of carbon oxide and dioxide would be halved in some years all over the world and not only in our towns and the mankind would have a moment's respite and more time to device a deeper and more radical solution.

As we have to use motor vehicles operated by internal combustion engines still for many years, one should at least aim at improving the efficiency of these engines by designing new engines that can replace almost immediately and economically the engines now used all over the world, that is engines adapted to operate with half or even better less than half quantity of the presently required gasoline or gas-oil.

The solution consists of the rotary engines. The well known Wankel engines that did not enjoy a great success, being afflicted by the problem of the high wear of the compression rings rubbing inside the combustion chamber with epitrochoid profile, have an efficiency which is hardly better than the reciprocating engines but they are not a final solution of this problem.

The solution is a really rotary engine without problems of high friction between the piston and the inner surface of the combustion chamber. This goal is attained by the rotary engine of the present invention because it increases actually and greatly the generally efficiency of the internal combustion engines practically reaching more than double values.

RESULT OF THE INVENTION

Halving the consumption with the engines of the invention will also halve the operating costs of motor vehicles with great savings in the economic budget of families, and this will be the powerful mainspring convincing everybody to change the car in the shortest possible time. This solution will be within the means even of the population of the developing countries.

Recycle of changing the entire car fleet would occur in few years in the developed countries with an immediate benefit for the pollution rate in the big towns and in the entire world.

Therefore the countries would not be obliged to create a distribution network of batteries of hydrogen for vehicles, and could use instead the present structures for distribution of fuels and less expenses would be required at a global level, so that the targets whished by the Kyoto Protocol could be reached more quickly.

Less emissions would be obtained all over the world certainly in a quicker way and with this solution no problem would be shifted to other places and new problems would not be created, on the contrary other problems would be reduced besides the pollution such as the immediate reduction of fuel demand with a drastic reduction of oil imports and of the pollution generated by its transportation and refining.

Oil producing countries would apparently be damaged in view of the rapid reduction of oil demand, but even these countries would actually gain by extending the residual life of their oil fields allowing a longer activity and exploitation time.

This would cause a rapid recovery of the automotive industry, presently declining in view of market saturation with the present cars and trucks with a high consumption; the entire world would proceed to change the whole car fleet and all other mobile and fixed machines adapted to use these engines.

There would be no more need to use immediately the atomic energy for producing hydrogen and the extension of the residual life of the oil fields would give to the mankind more time to find out alternative clean energetic sources.

SUMMARY OF THE INVENTION

The rotary engine of the present invention is illustrated in a fairly detailed way on the attached sheets of drawings that are integral part of the present description.

The novel solution consists in that this engine comprises two rotors one inside the other, rotating in the same direction and at the same number of revolutions.

Just to make a comparison one could say that the internal rotor corresponds to the piston and the external rotor to the cylinder and head or to the Wankel chamber with epiprotrochoid profile.

The two rotors are contained in a case that is contacted by the rotors only at the bearings. The head function is integrated in the external rotor on which the intake and discharge valves, the timing system and the sparking plugs are assembled. On the internal rotor the injection pump and the injectors are installed. The intake and discharge valves are of an innovative type with two motions so as to eliminate almost entirely any reciprocating motion.

BRIEF DESCRIPTION OF THE DRAWINGS

The drawings referred to in the following description are listed hereinbelow

Engine Assembling Sections

Figures 13A, 13B:
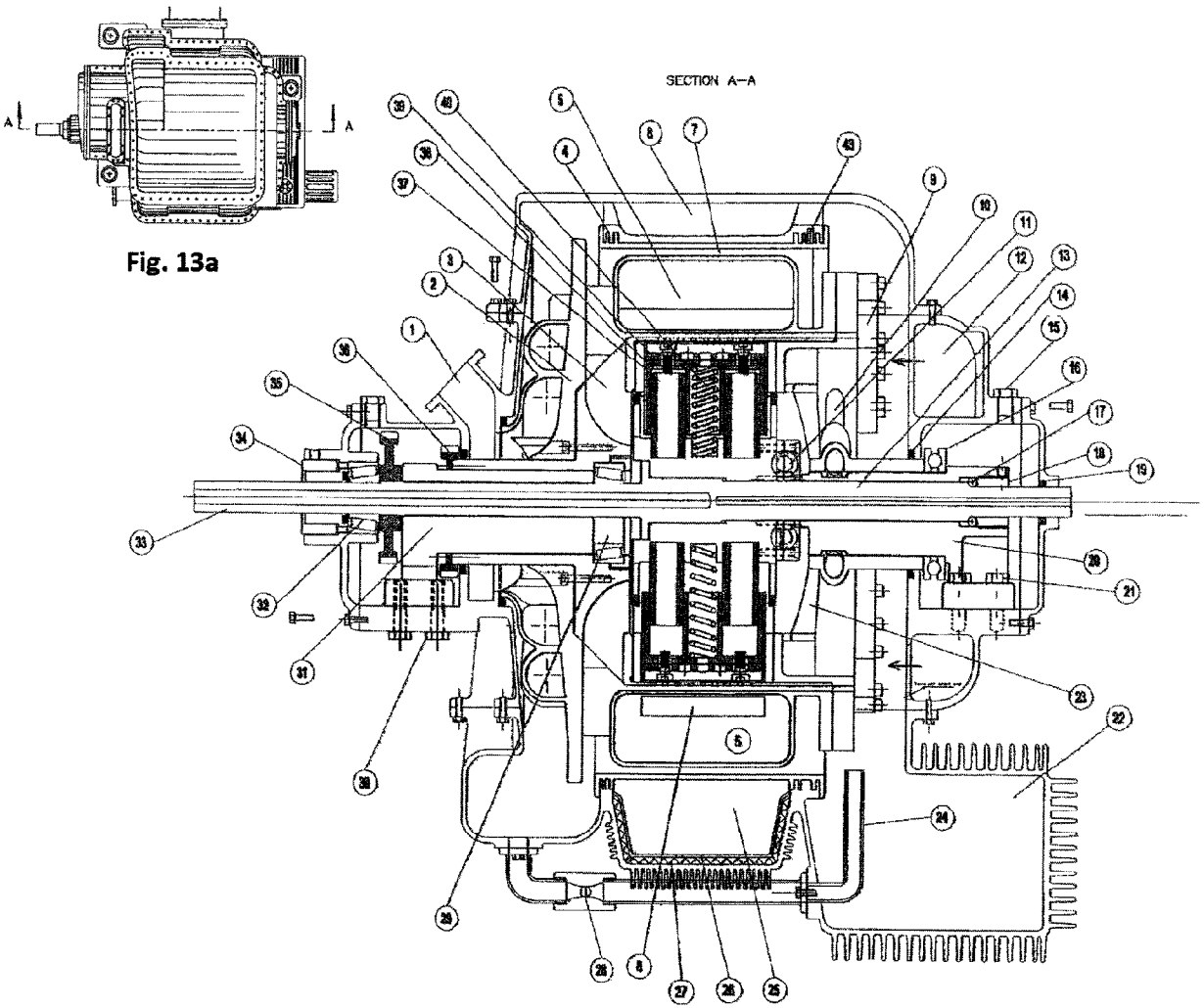

FIGS. 13*a*-13*b*—Engine axial section

Figures 14A, 14B:
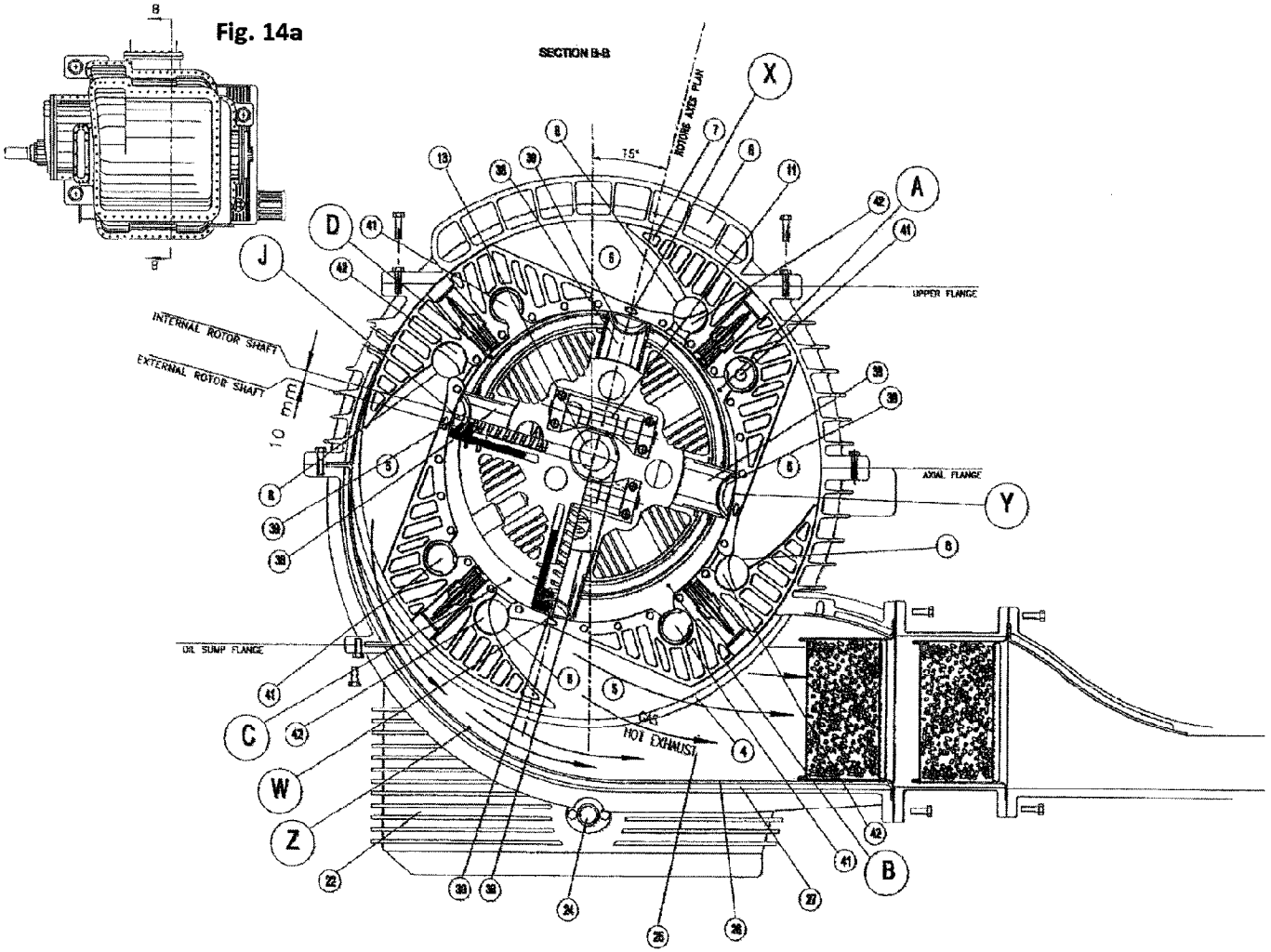

FIGS. 14*a*-14*b*—Engine crosswise section

Figure 15C:
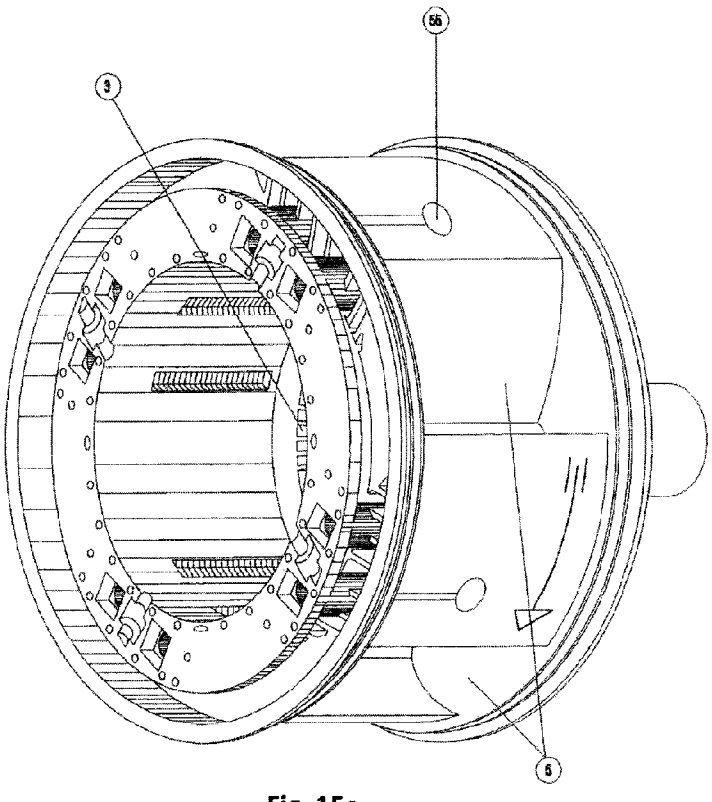
Figure 15B:
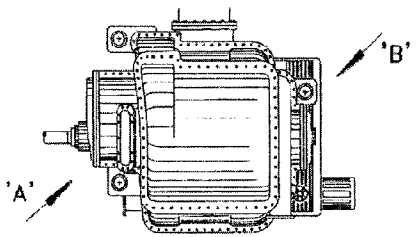
Figure 15A:
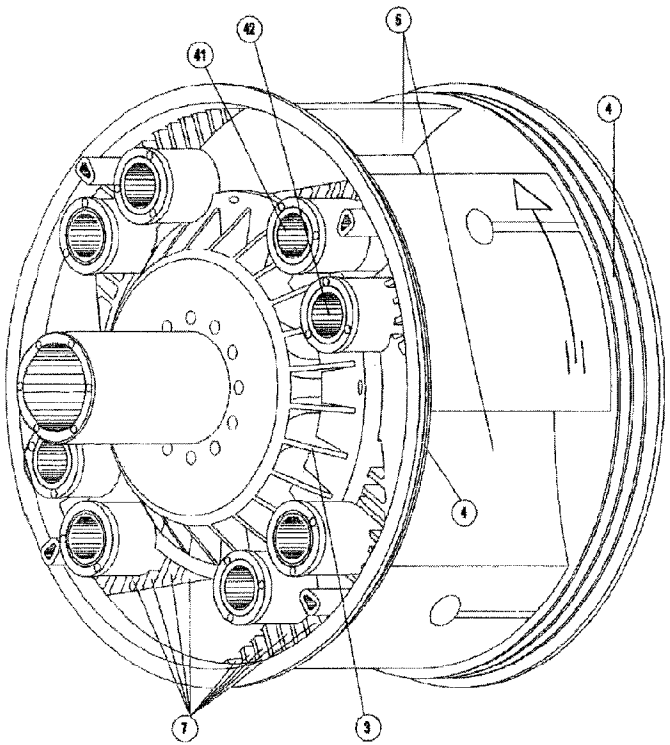
Figure 16C:
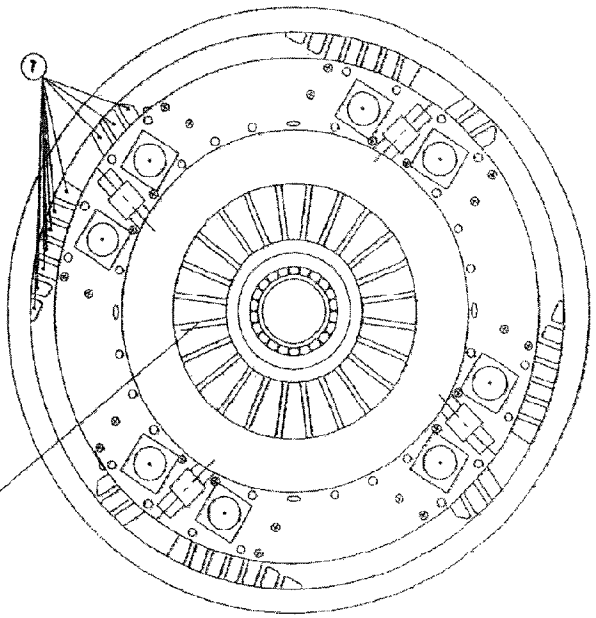
Figure 16A:
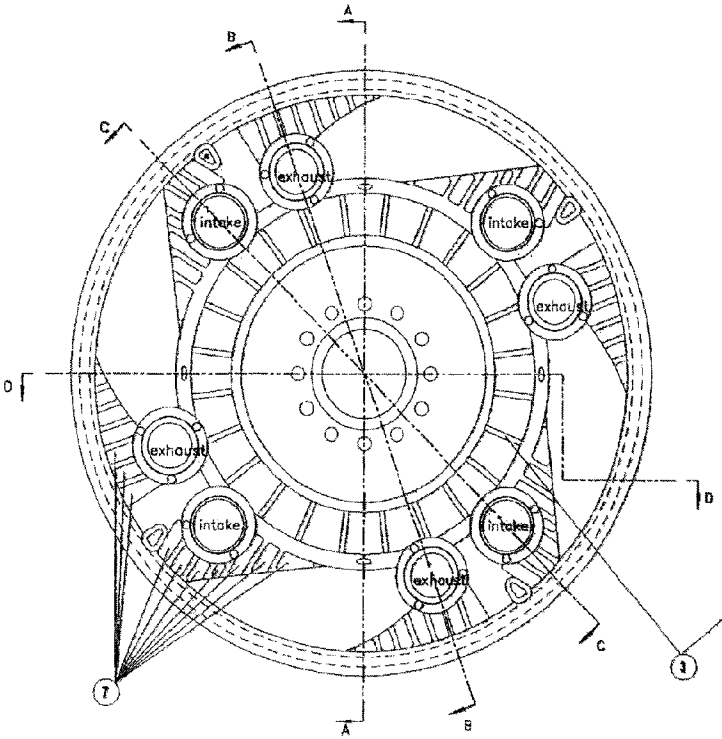
Figure 16B:
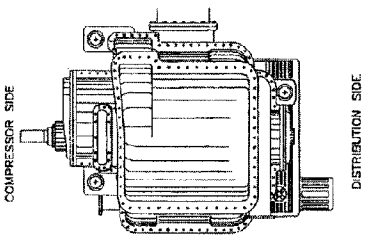
Figure 17B:
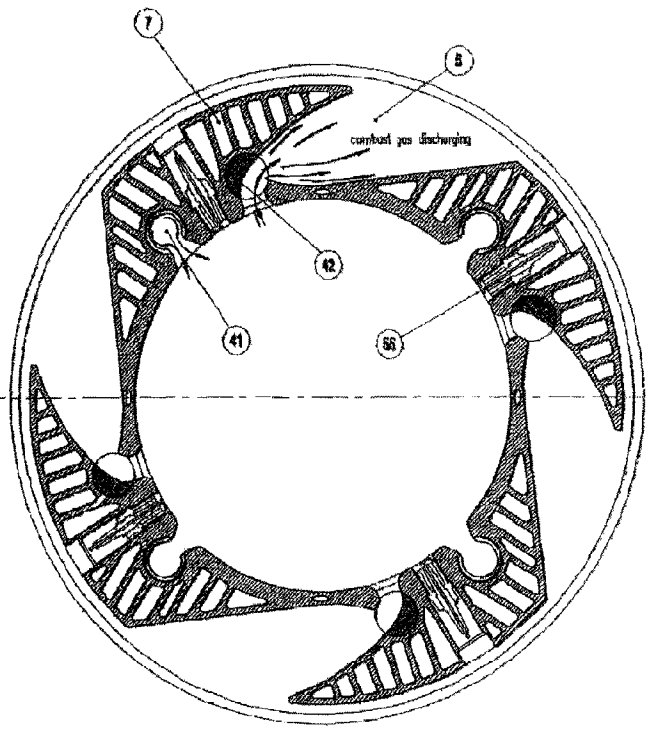
Figure 17A:
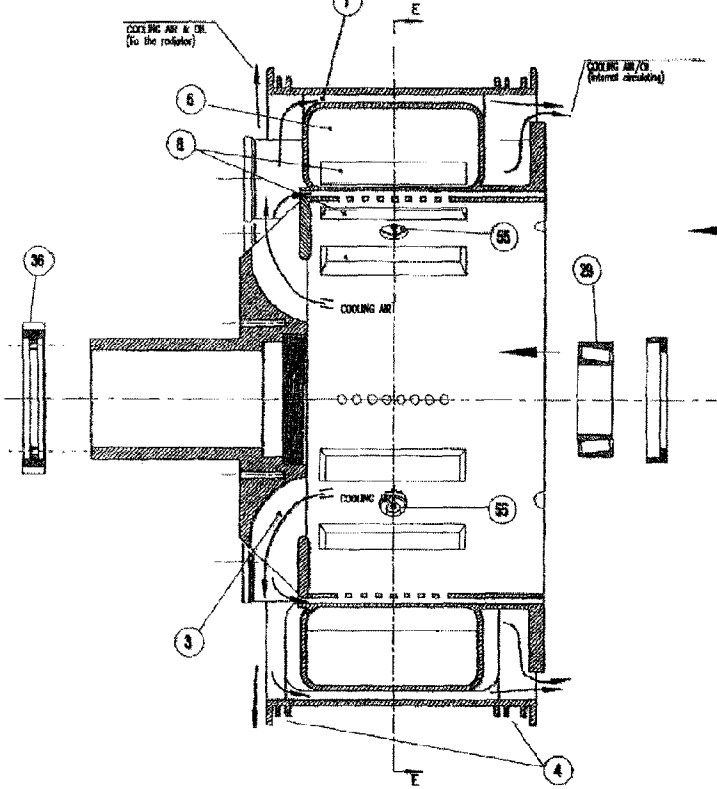
Figures 18A, 18B, 18C:
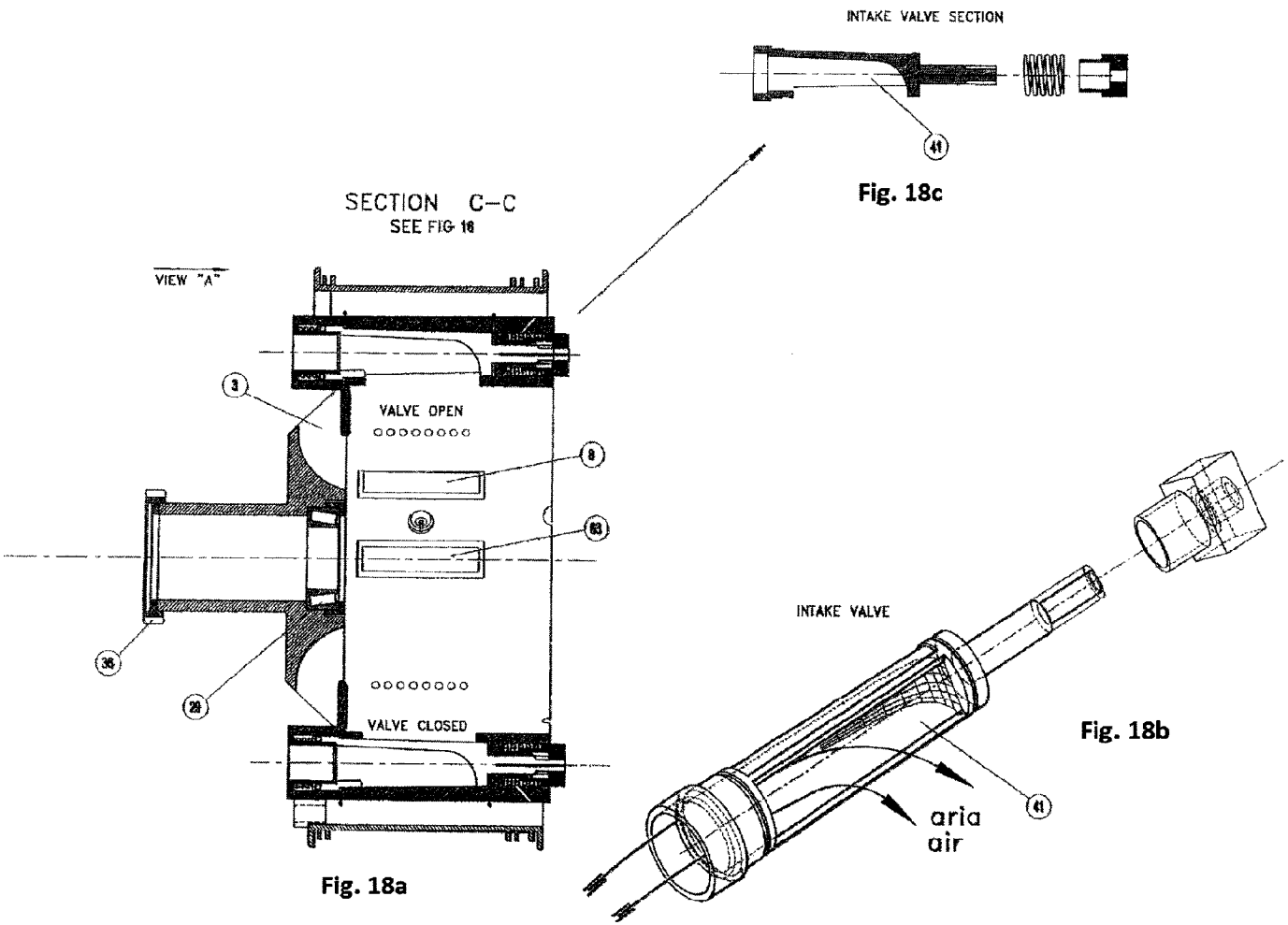
Figure 19C:
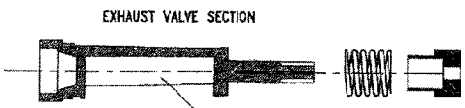
Figure 19B:
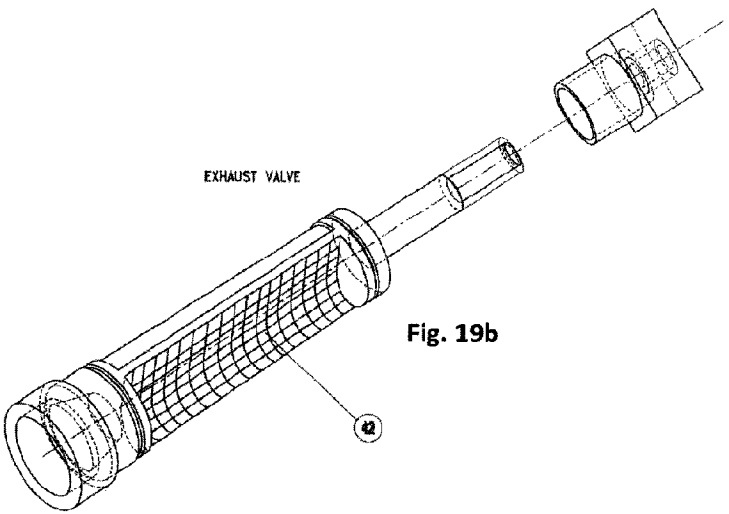
Figure 19A:
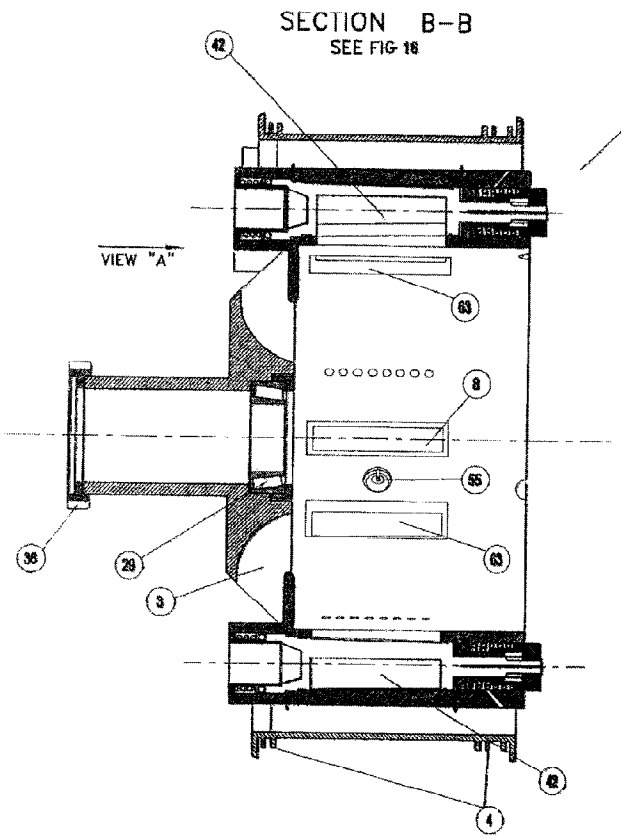
Figure 20:
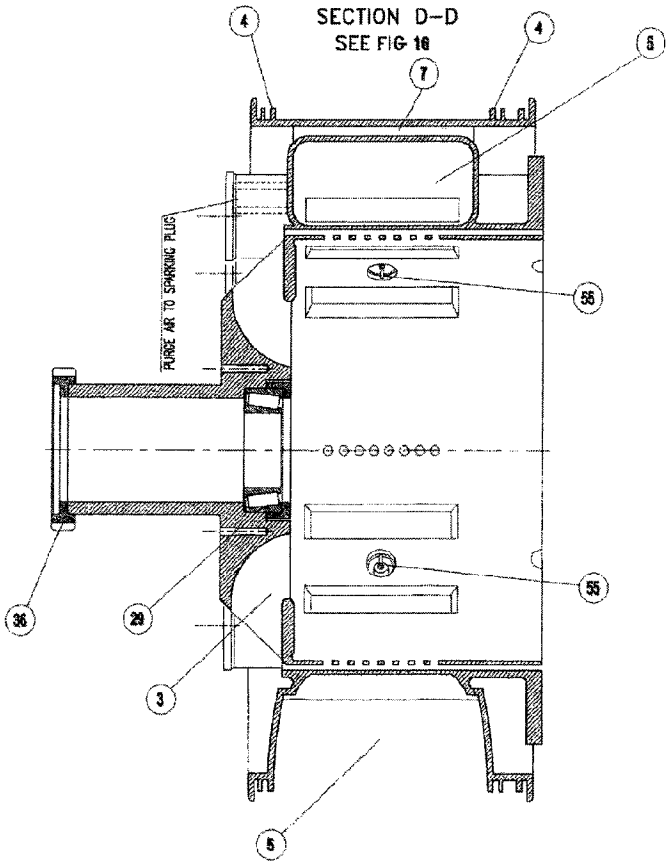
Figure 21C:
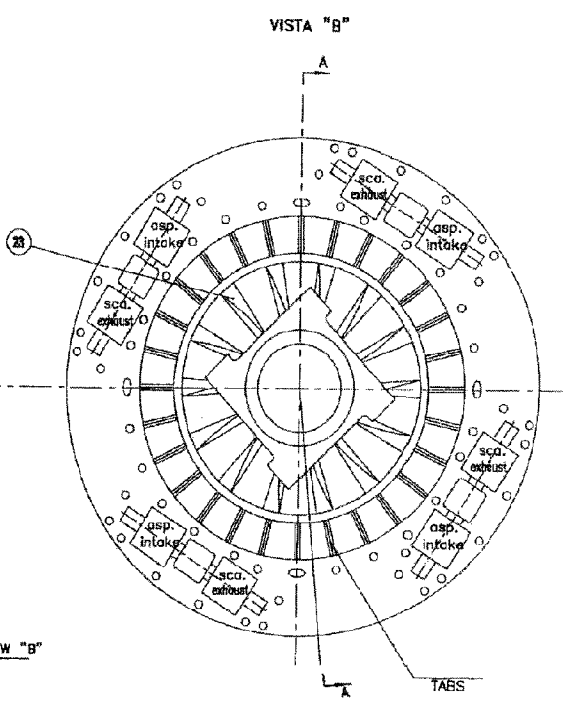
Figure 21B:
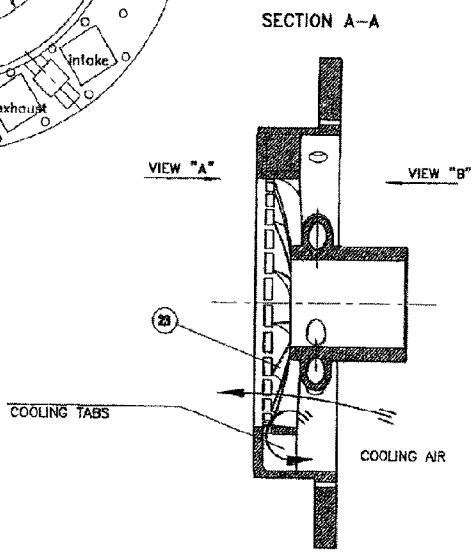
Figure 21A:
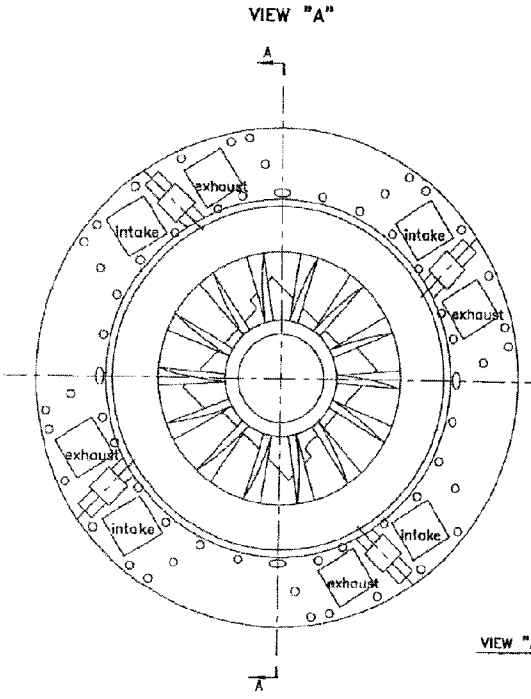
Figures 22A, 22B, 22C:
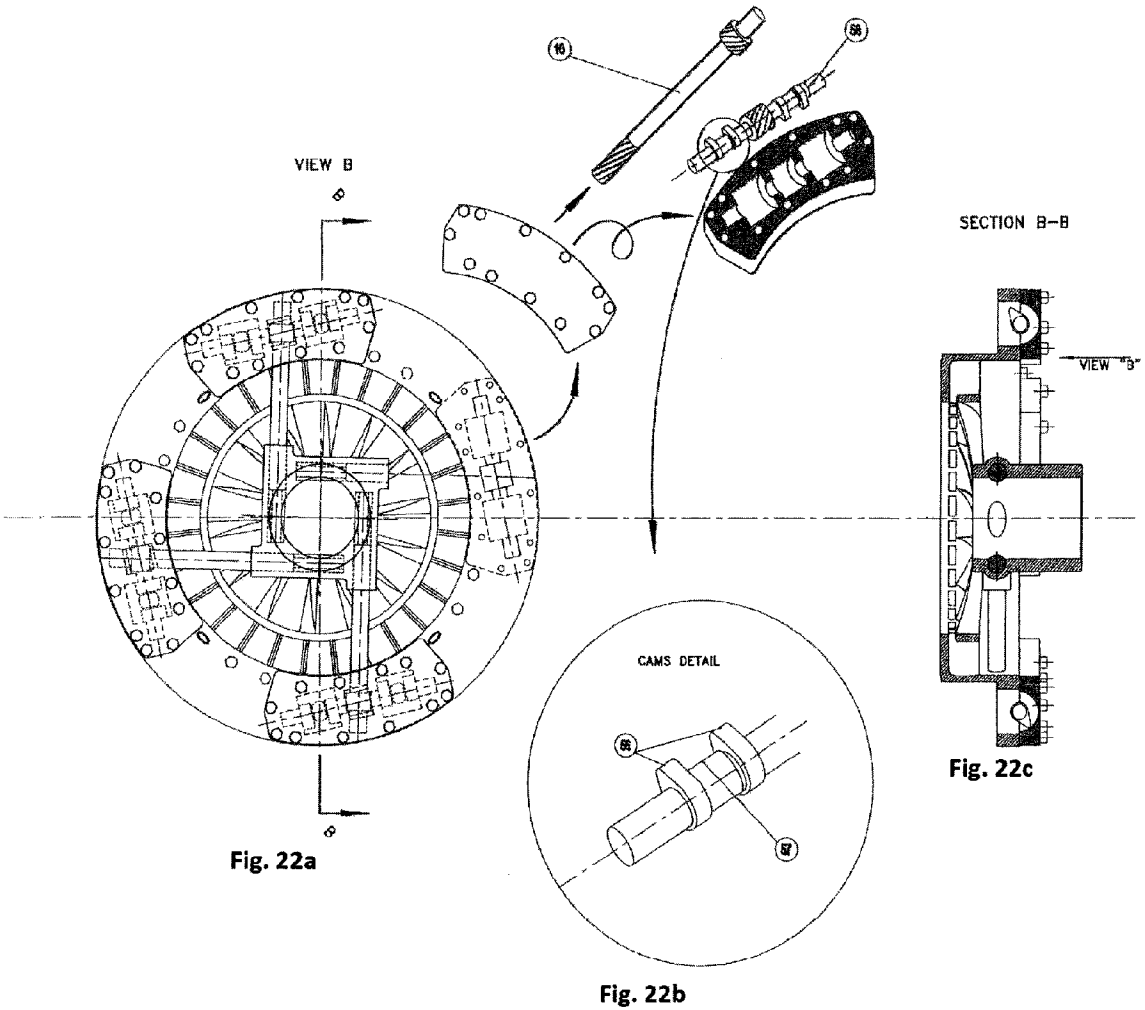
Figures 23A, 23B, 23C, 23D:
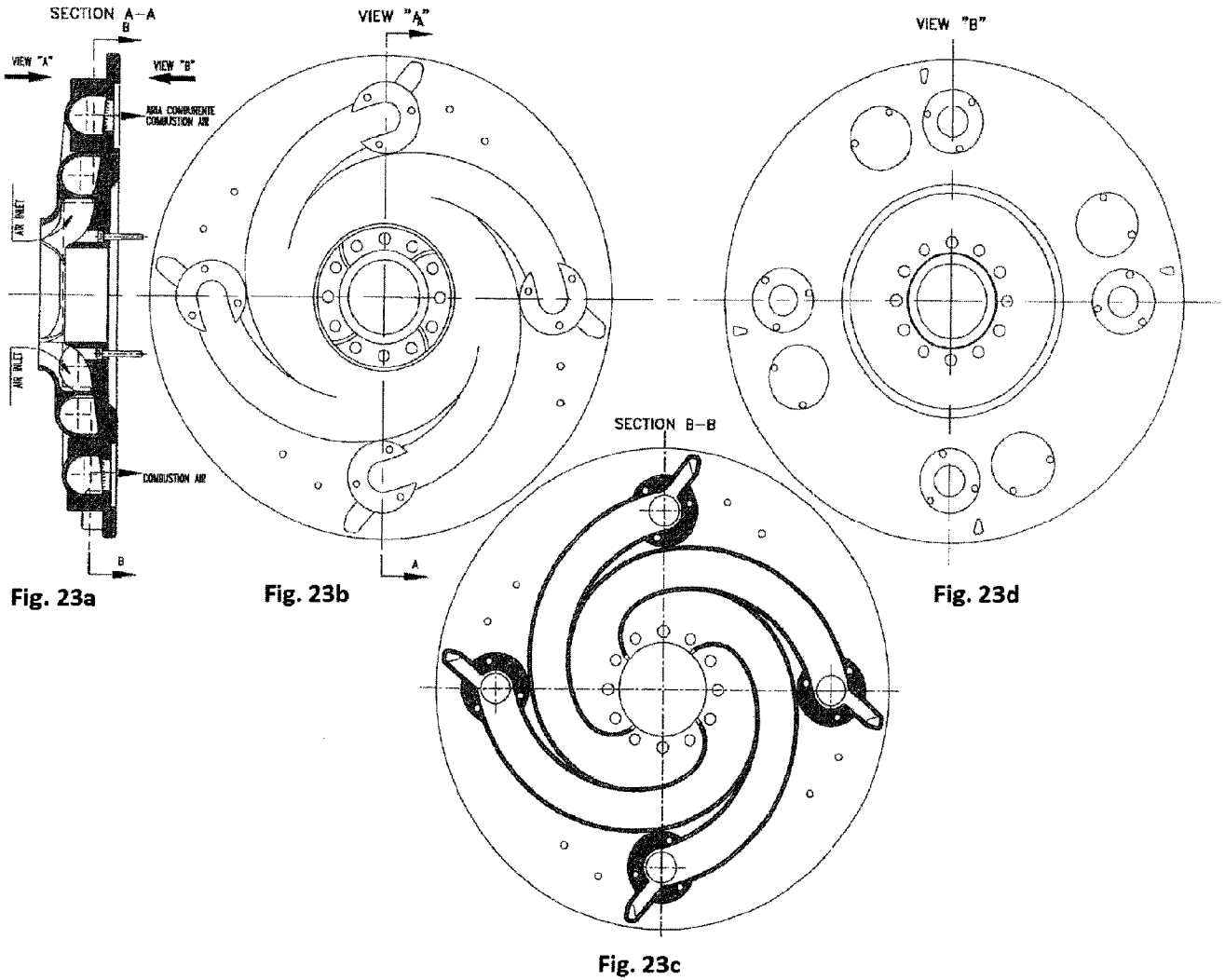
Figure 24:
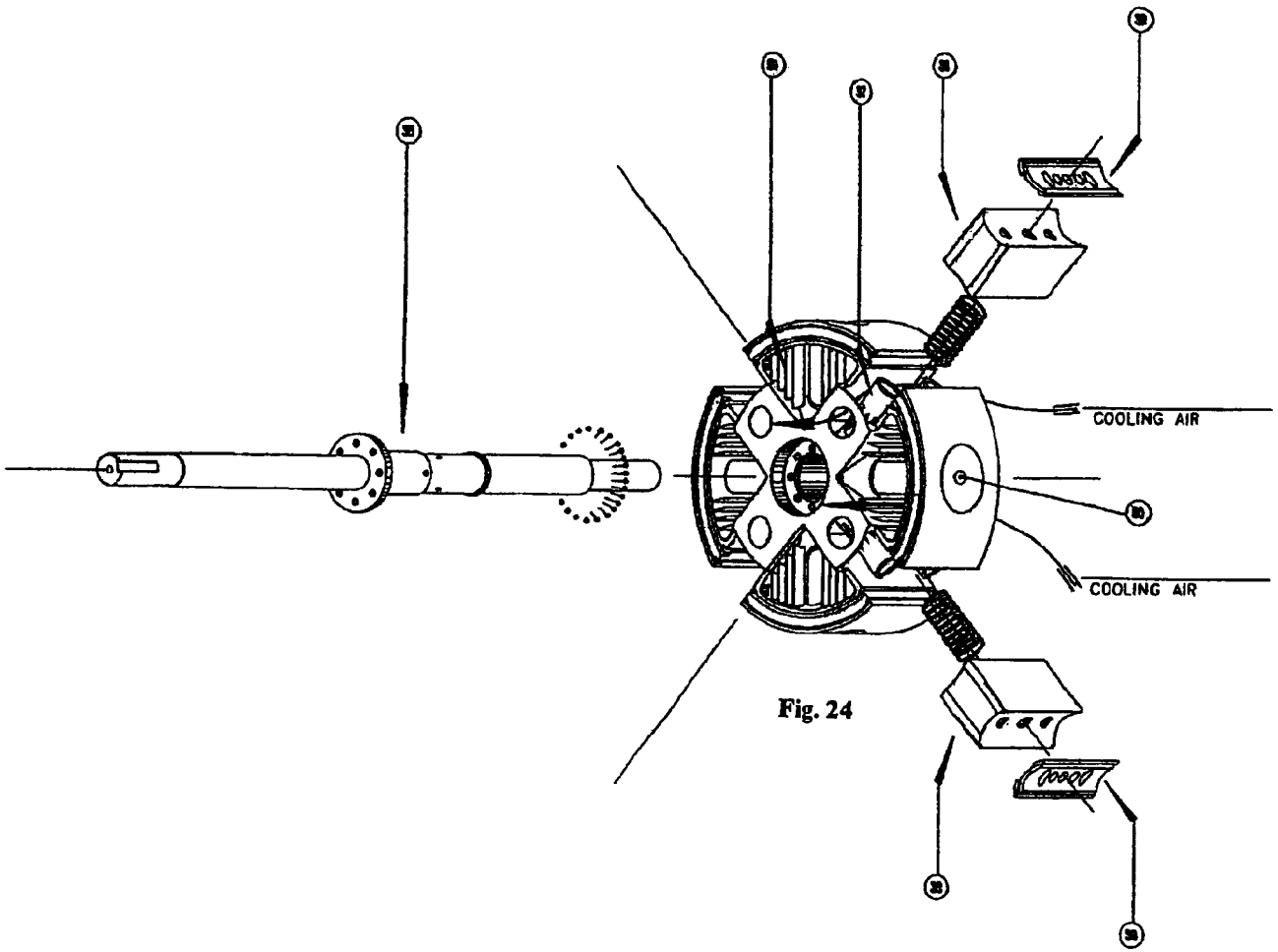
Figures 25A, 25B, 25C, 25D, 25E, 25F:
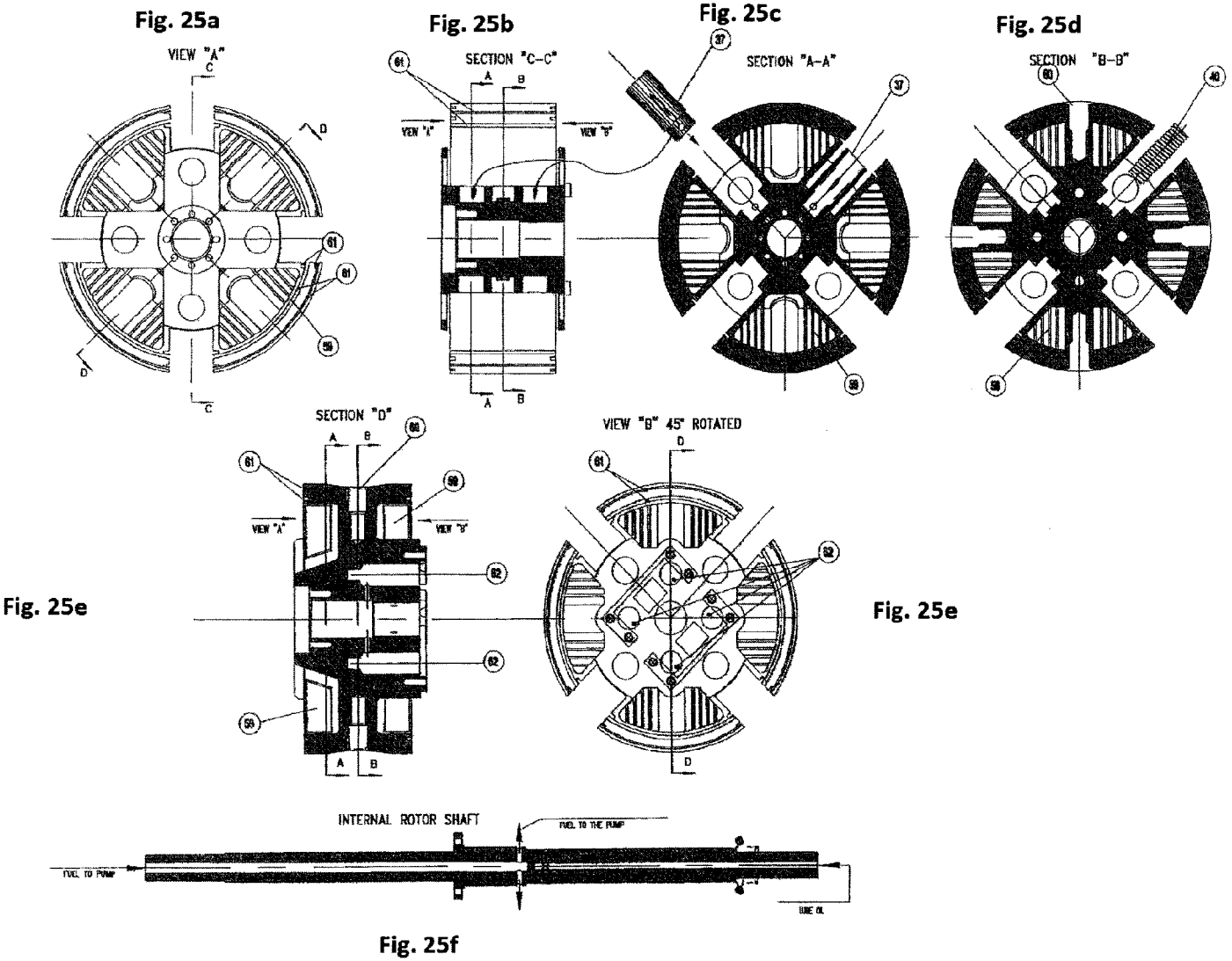
Figures 26A, 26B, 26C:
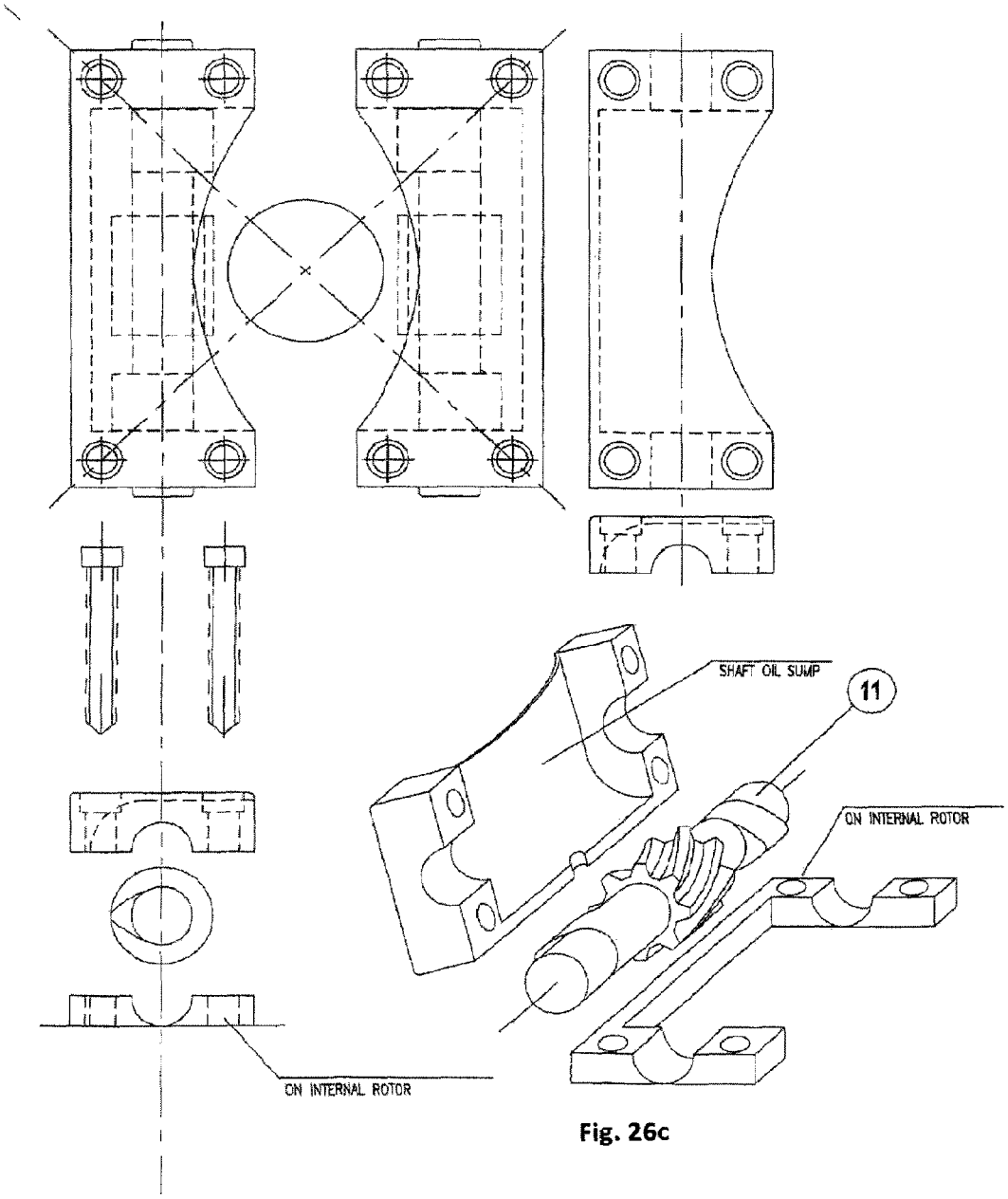
Figure 27:
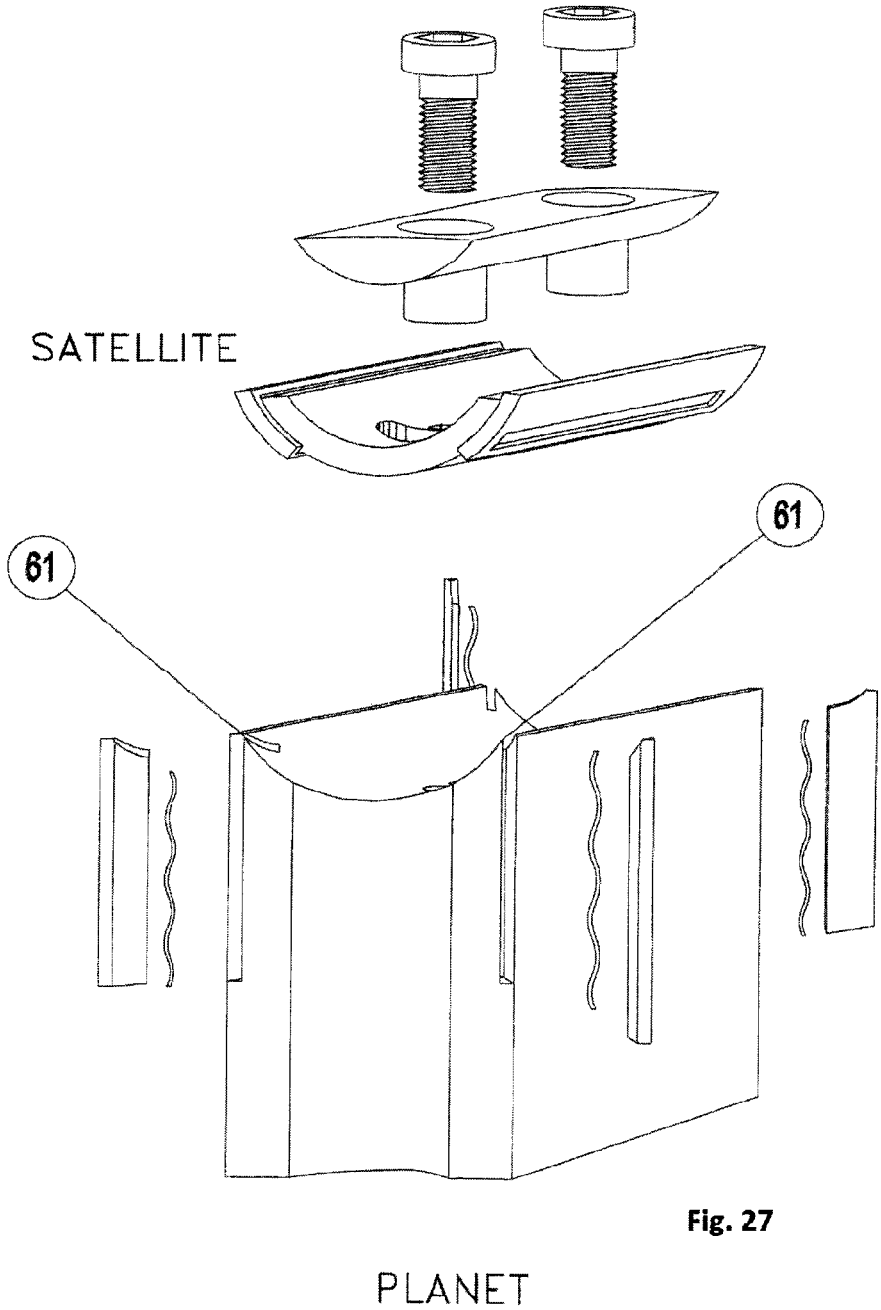
Figure 28A:
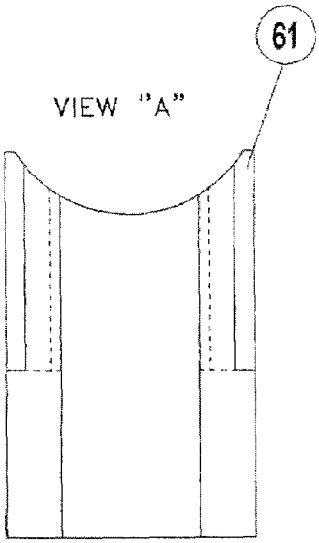
Figure 28B:
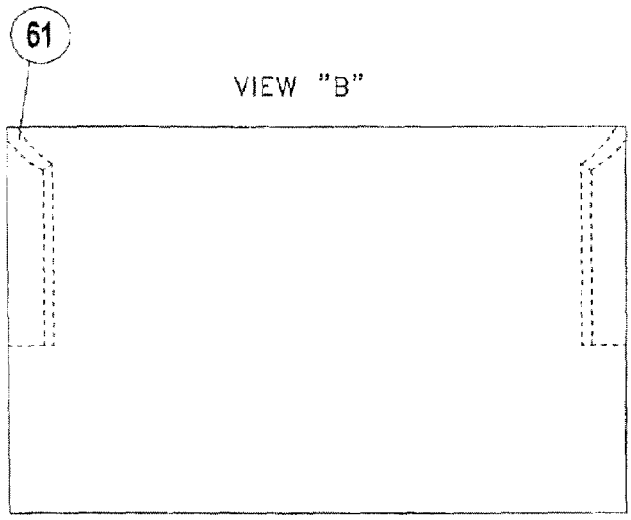
Figure 28C:
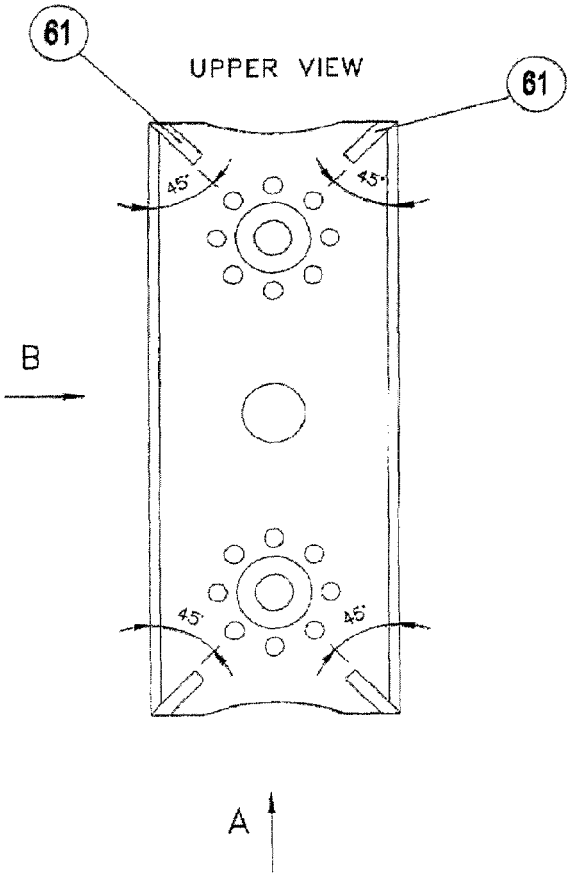
Figure 28D:
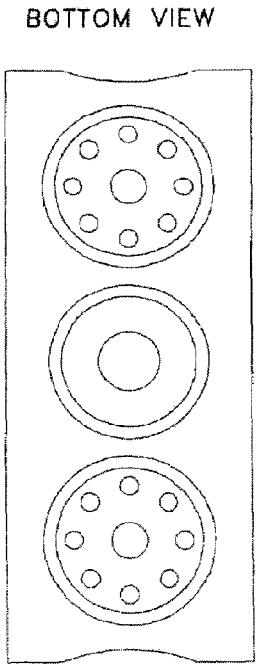
Figure 29A:
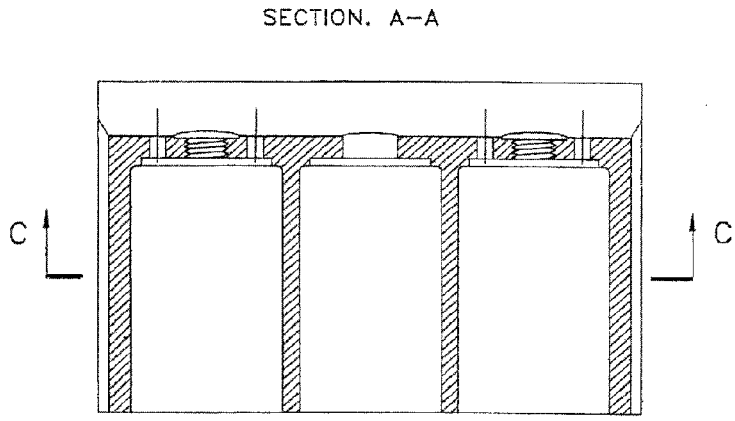
Figure 29B:
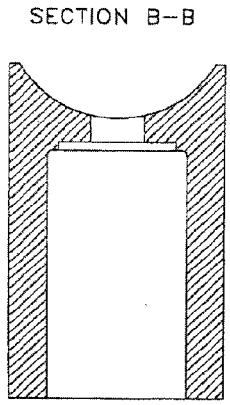
Figure 29C:
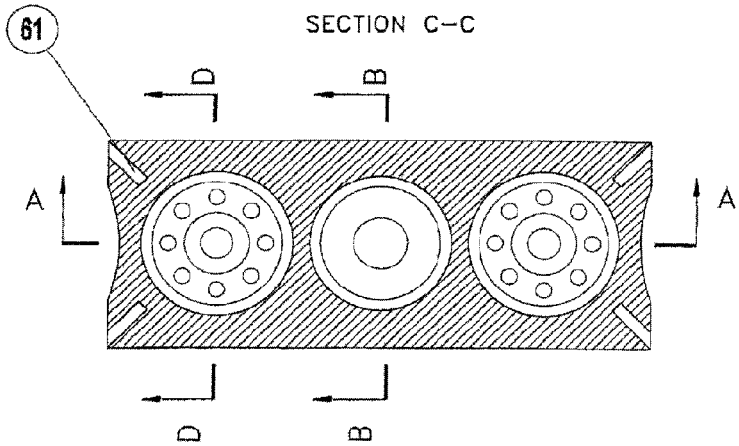
Figure 29D:
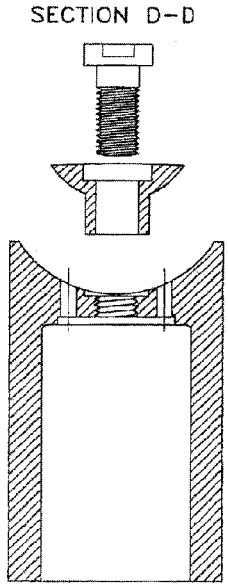
Figure 30A:
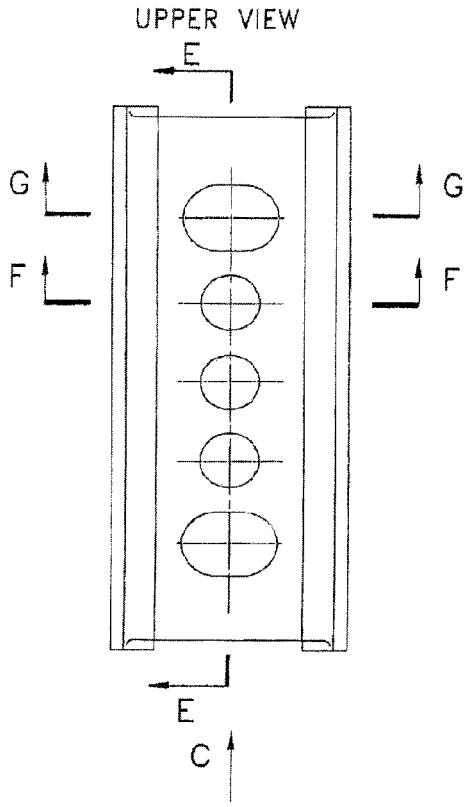
Figure 30B:
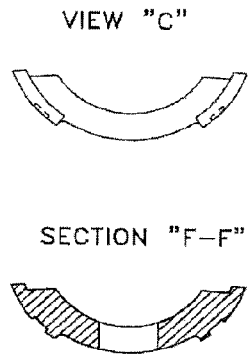
Figure 30C:
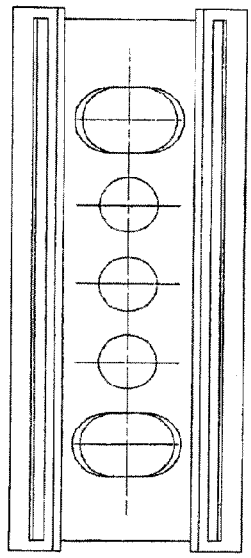
Figure 30D:
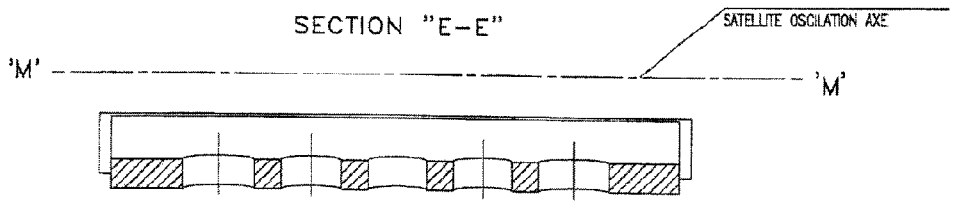
Figure 31:
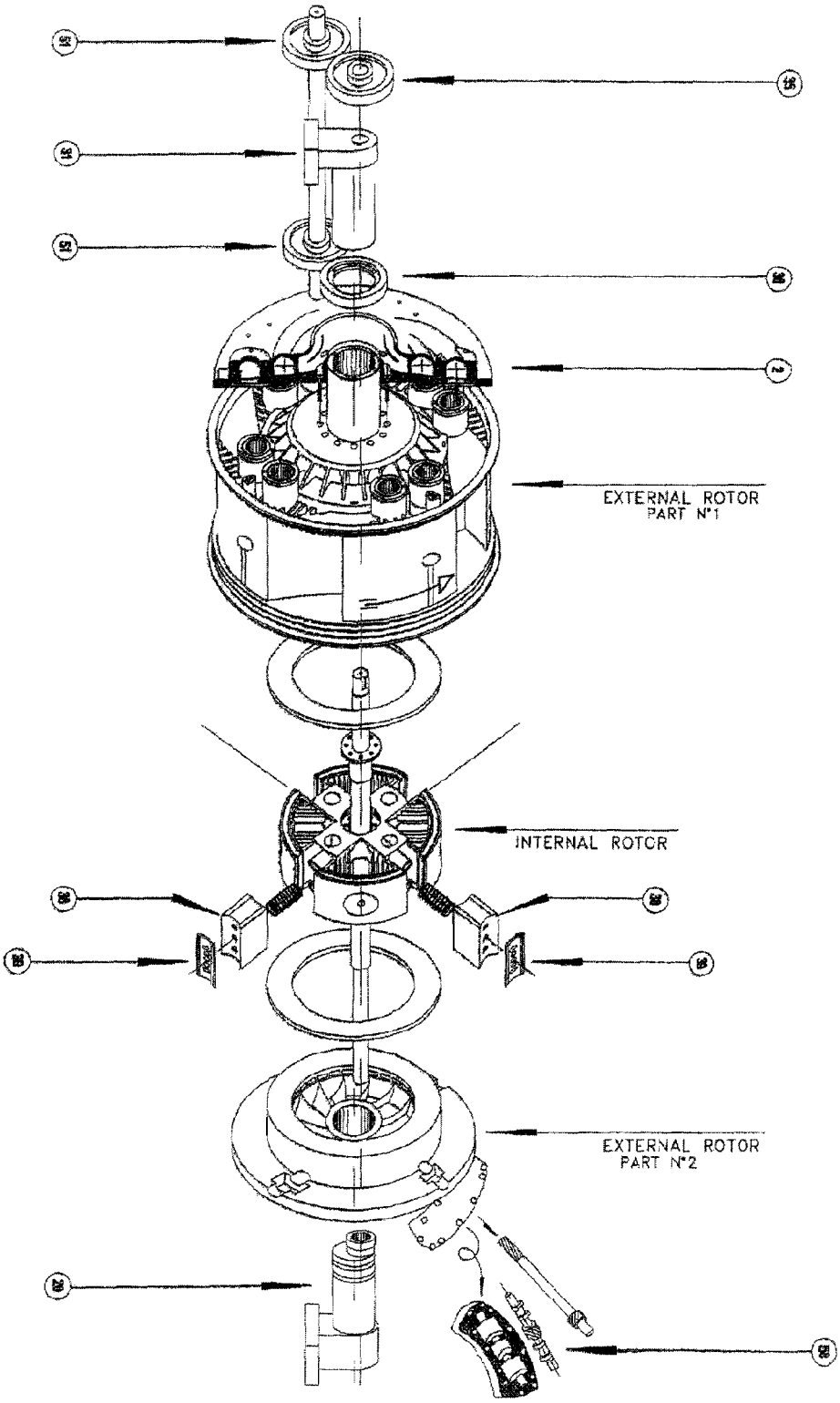
Figures 32A, 32B:
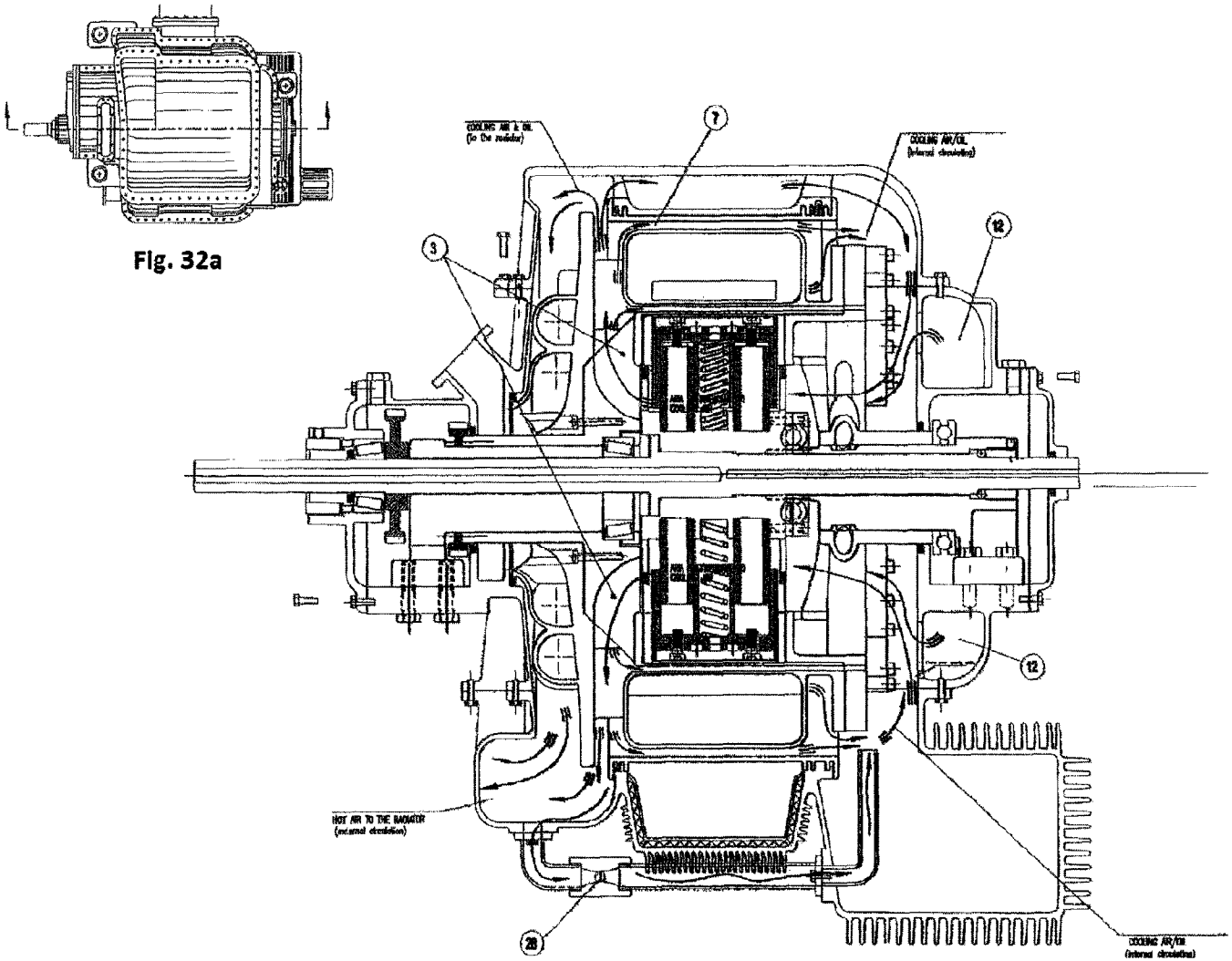

FIGS. 15*a*-15*c*—Part n°1 of external rotor—three-dimensional views FIGS. 16*a*-16*c*—Part n°1 of external rotor—views FIGS. 17*a*-17*b*—Part n°1 of external rotor—axial section A-A and crosswise section E-E FIGS. 18*a*-18*c*—External rotor Part n°1 -section on intake valves FIGS. 19*a*-19*c*—External rotor Part n°1 -section on exhaust valves FIG. 20—External rotor Part n°1 -axial section on the nozzles FIGS. 21*a*-21*c*—External rotor Part n°2 -views of faces and axial section FIGS. 22*a*-22*c*—Valves distribution assembly FIGS. 23*a*-23*c*—Supercharger—views and sections FIG. 24—Internal rotor and its shaft—exploded three dimensional views FIGS. 25*a*-25*f*—Internal rotor and its shaft—views and sections FIGS. 26*a*-26*c*—Injection pump camshaft FIG. 27—"Planet" and "Satellite"—exploded view FIGS. 28*a*-28*d*—"Planet"—views FIGS. 29*a*-29*d*—"Planet"—sections FIGS. 30*a*-30*d*—"Satellite"—views and sections FIG. 31—Engine rotors assembly exploded view FIGS. 32*a*-32*b*—Cooling air circulation system

DETAILED DESCRIPTION OF THE PREFERRED EMBODIMENT

Figure 9B:
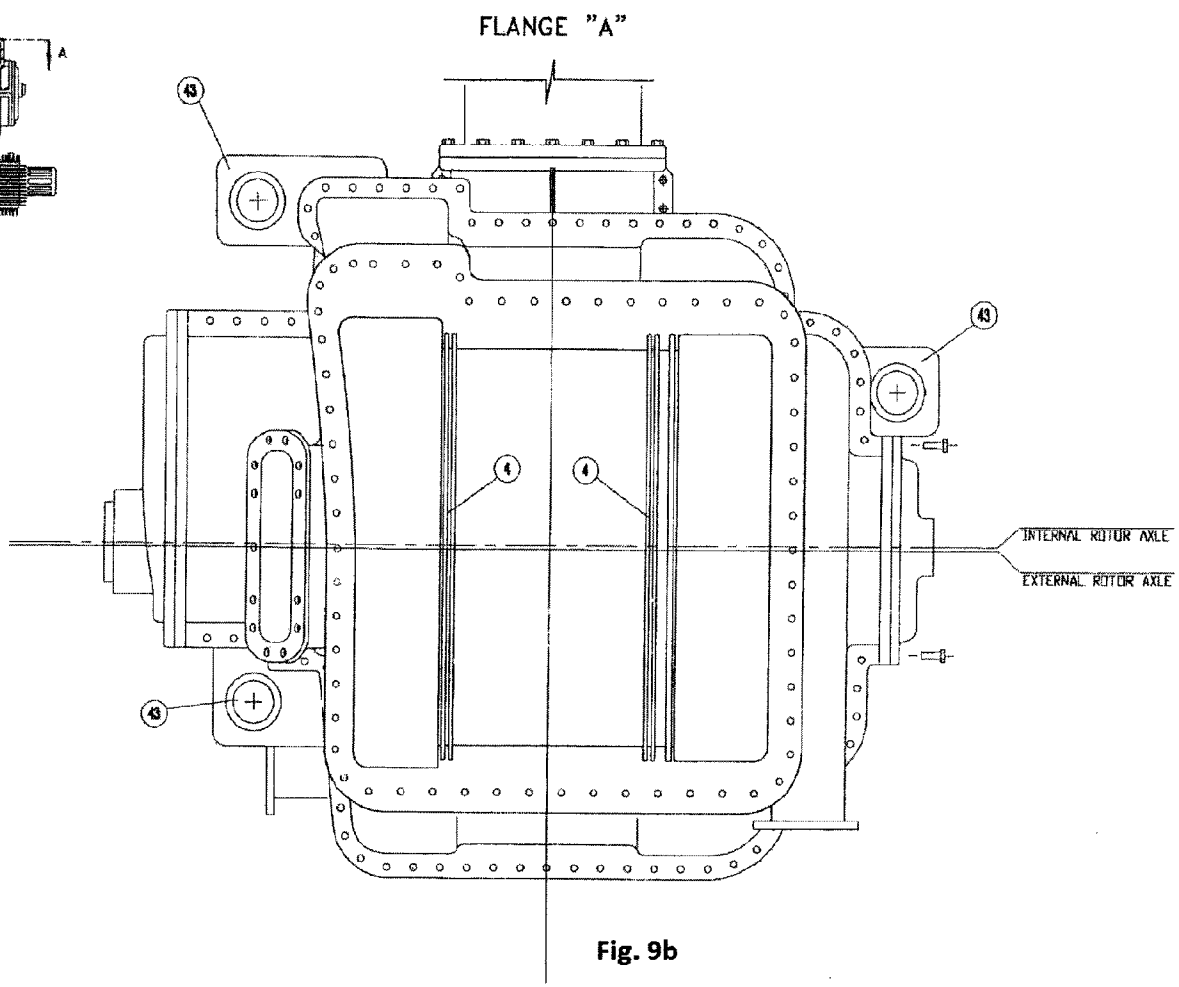
FIGS. 9*a*-9*b* Case—upper flange A
Figure 9A:
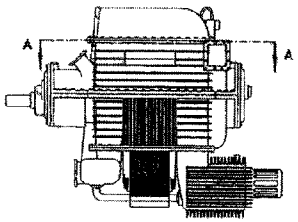

The rotary engine of the present invention illustrated in the drawings is an engine with a displacement of about 1500 c.c. with an overall dimension of about 560 cm along the axis, 480 cm in the direction crosswise the rotation axis and about 480 cm in the vertical direction (FIGS. 1, 2, 3 and 4). The case comprises four elements bolted on three coupling flanges as shown on FIGS. 1, 2, 3, 5*a*-5*b*, 6*a*-6*c* and 7*a*-7*b*. The shape of the flanges is shown on FIGS. 9*a*-9*b* (Upper flange A), FIGS. 10*a*-10*b* (Axial flange B) and FIGS. 11*a*-11*b* (Flange C of the oil sump).

In the case two rotors one inside the other are moving, whose rotation axes are arranged on a plane inclined 15 degrees to the vertical (see FIGS. 14*a*-14*b*) and spaced 10 mm one from the other. The values of 15 degrees and the 10 mm of distance between the rotors may be varied as a function of the designed displacement of the engine and shape, orientation, and size of the nozzles and discharge valves described hereinafter.

Figure 1:
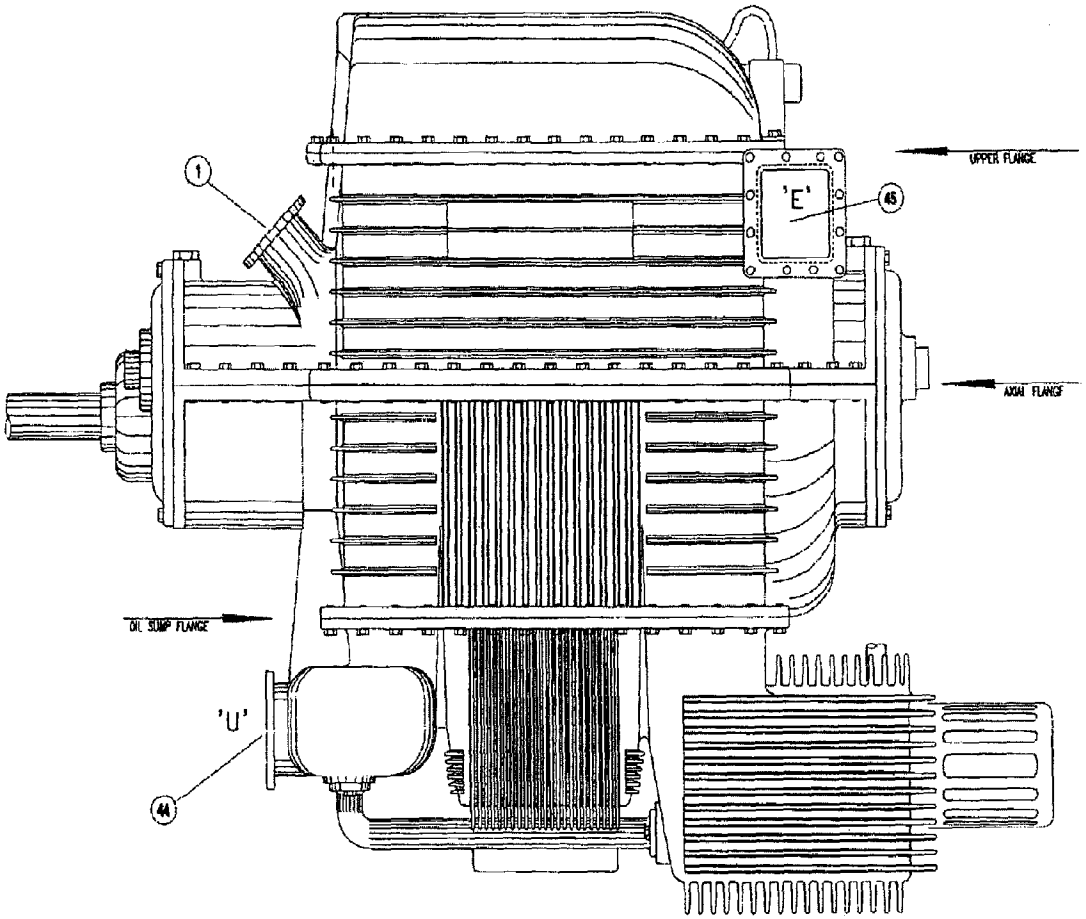
FIG. 1—External front view
Figure 2:
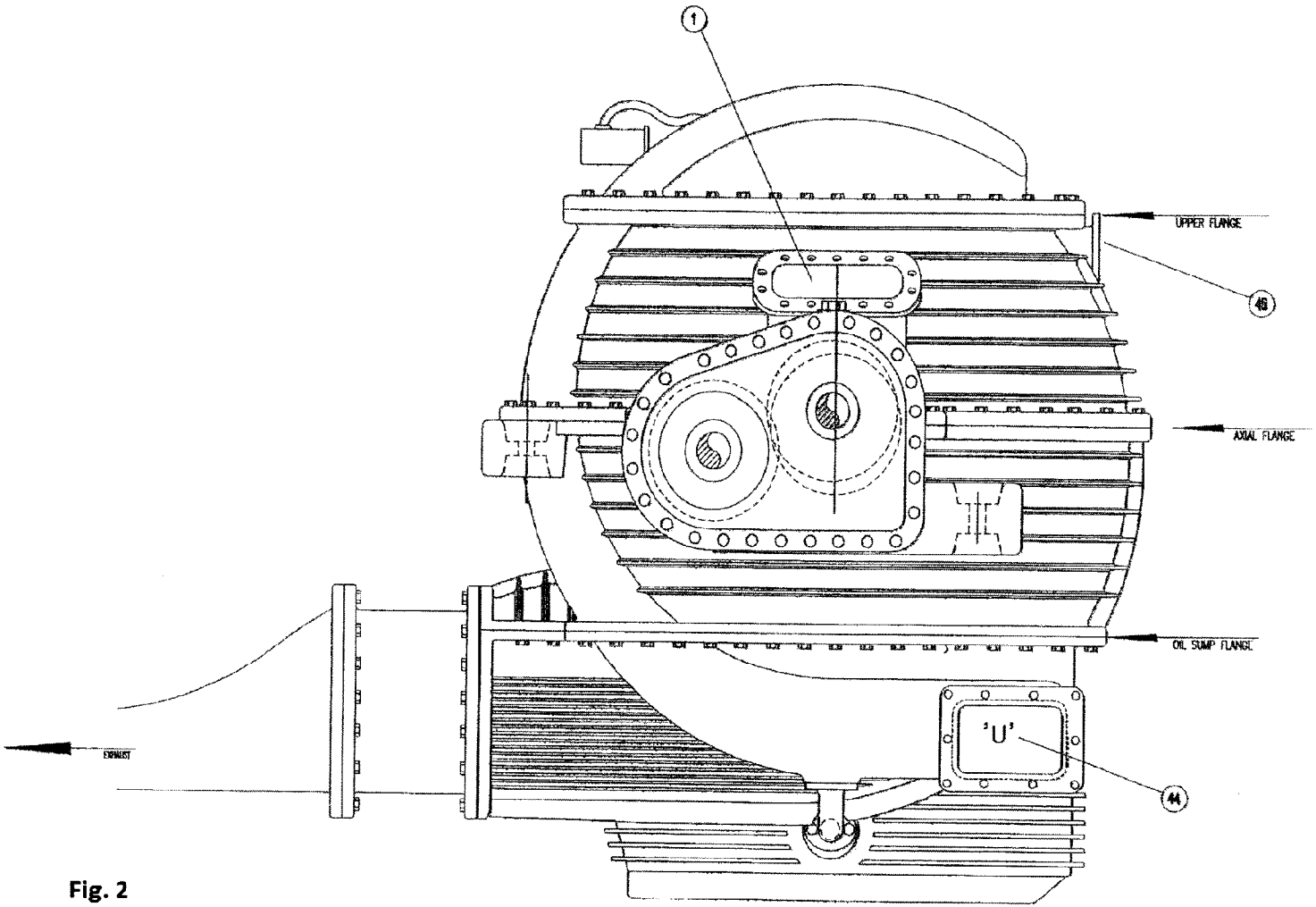
FIG. 2—External view looking air intake side
Figure 3:
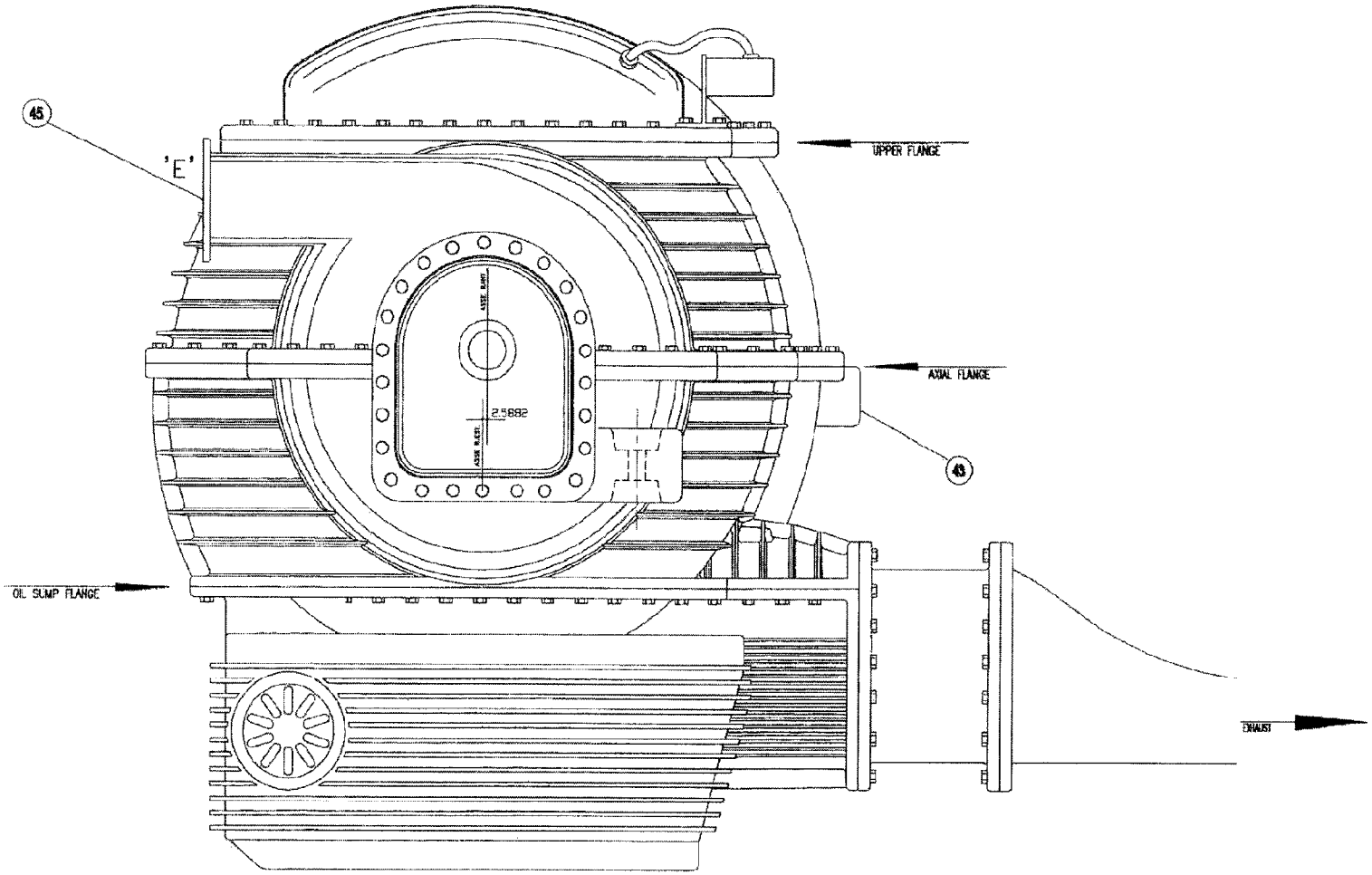
FIG. 3—Cooling air inlet side view
Figure 4:
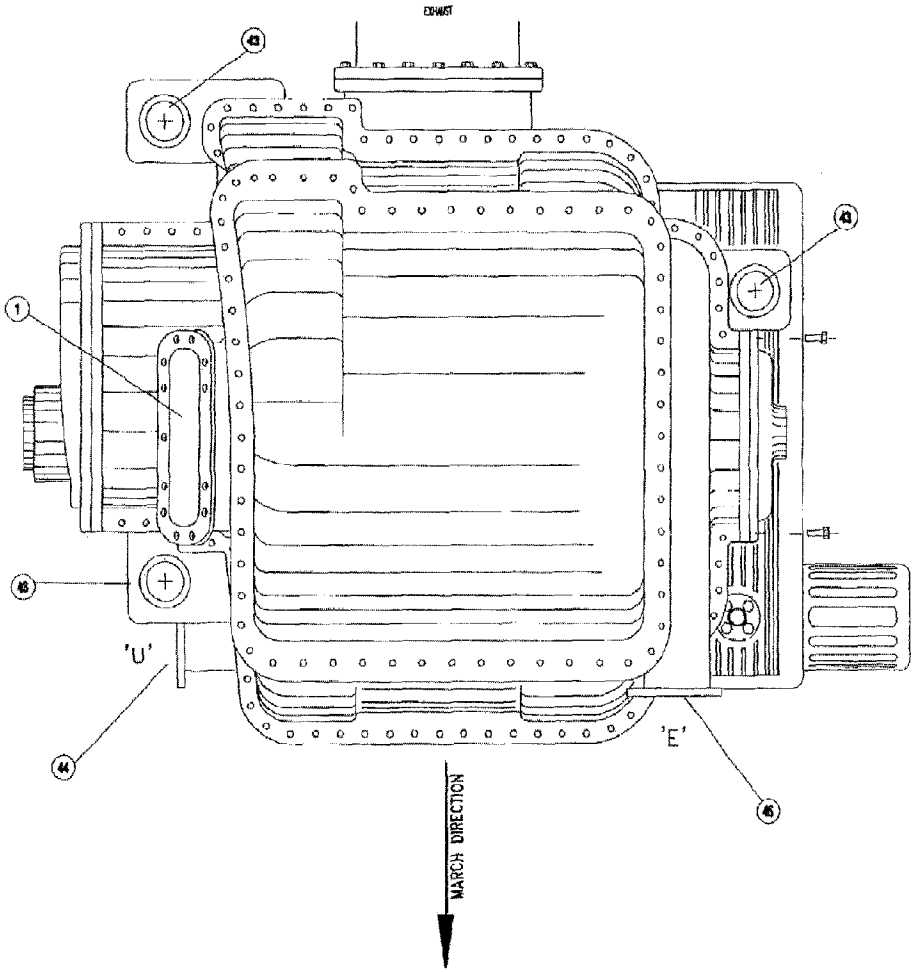
FIG. 4—Top view
Figures 5A, 5B:
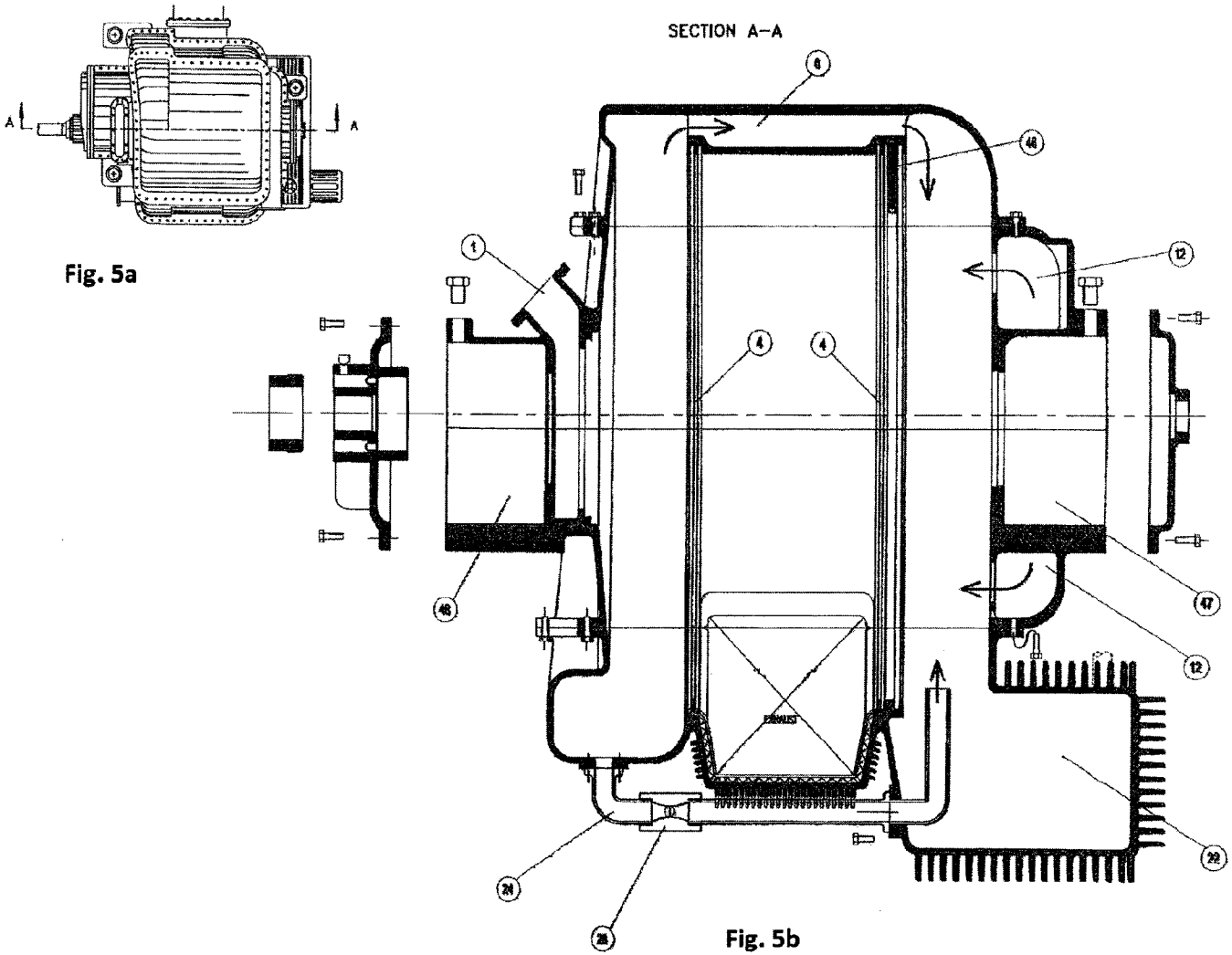
FIGS. 5*a*-5*b*—Axial case section
Figures 6A, 6B, 6C:
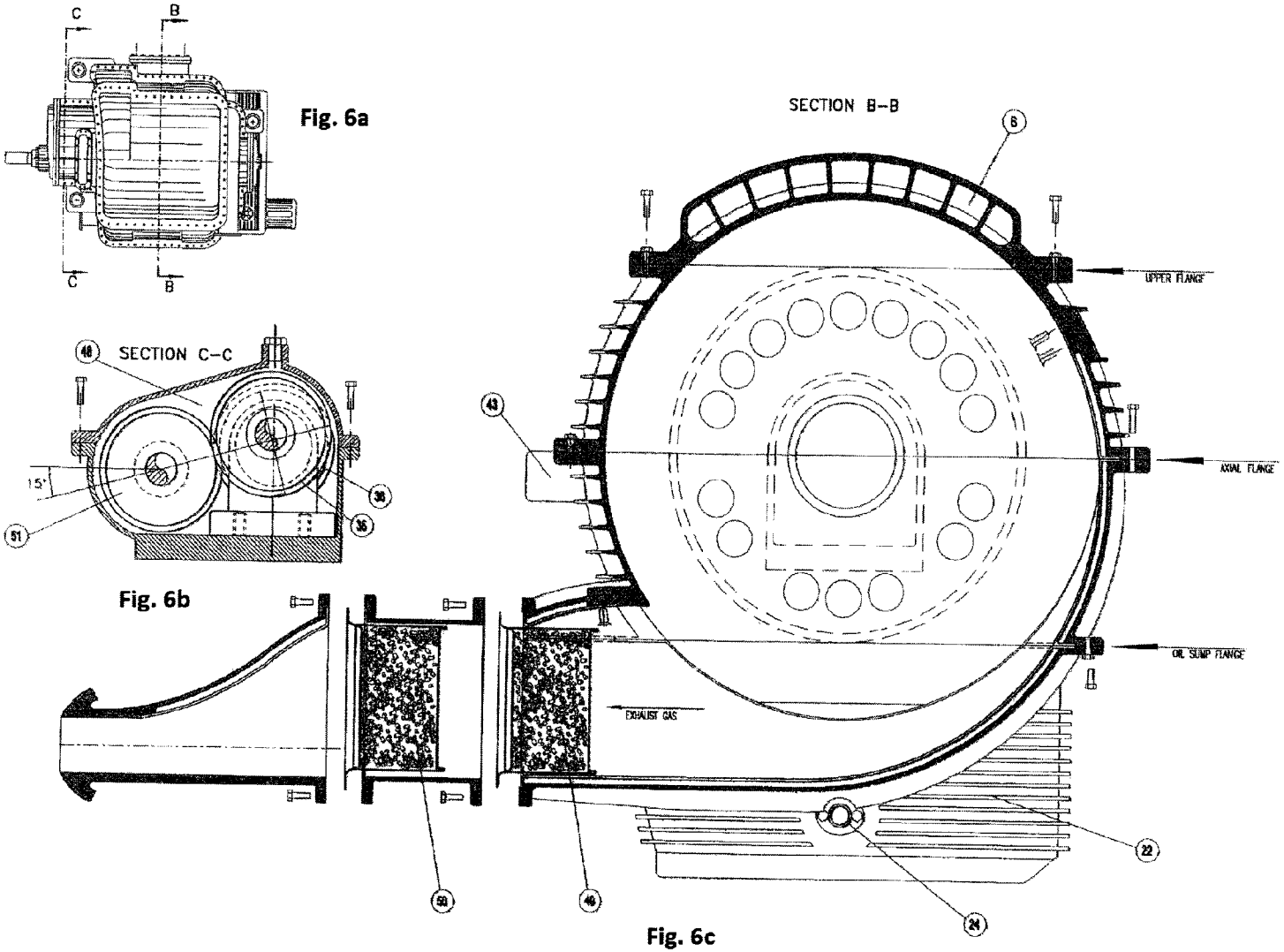
FIGS. 6*a*-6*c*—Axial crosswise case section—looking distribution side
Figures 7A, 7B:
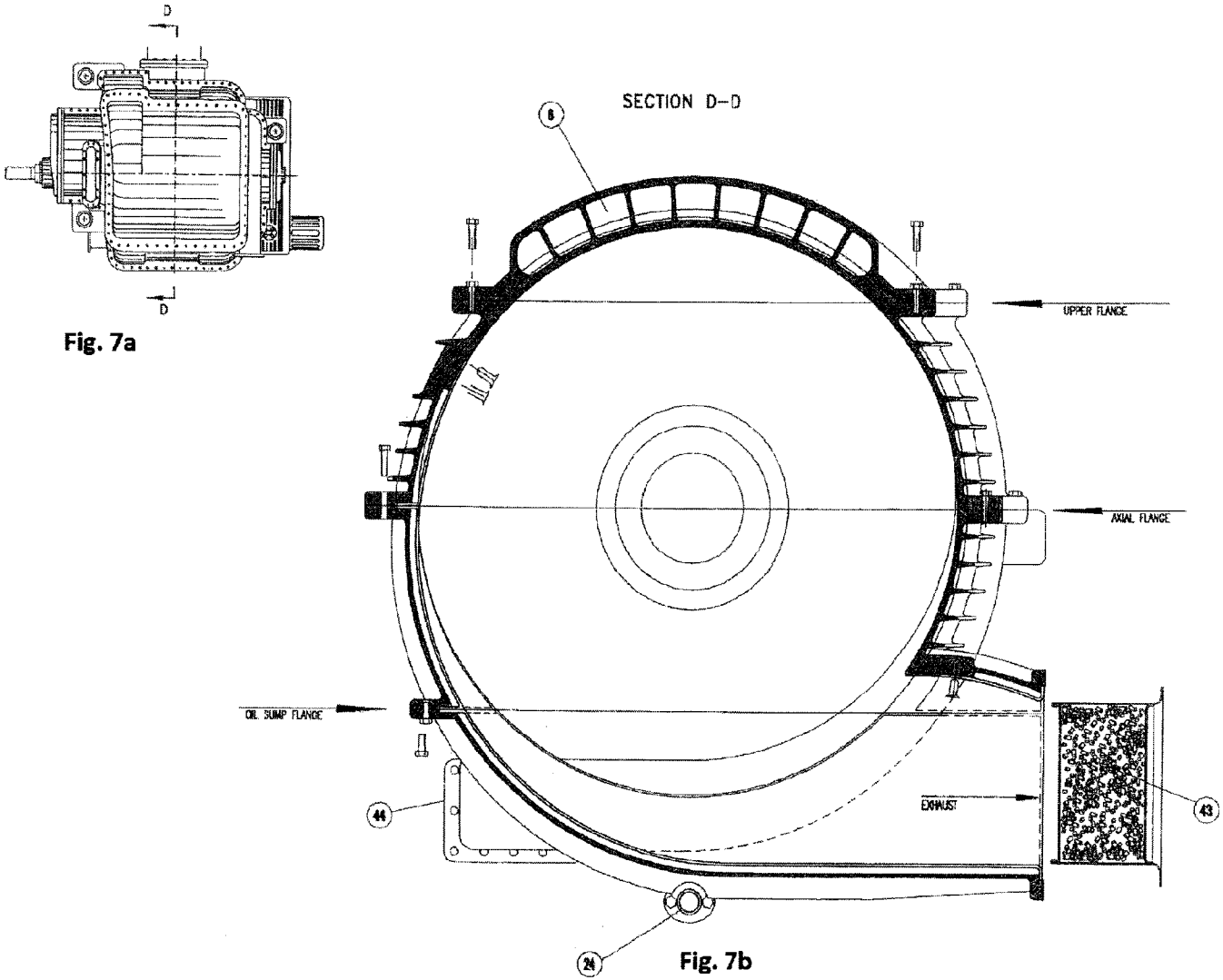
FIGS. 7*a*-7*b*—Axial crosswise case section—looking supercharger side
Figure 8B:
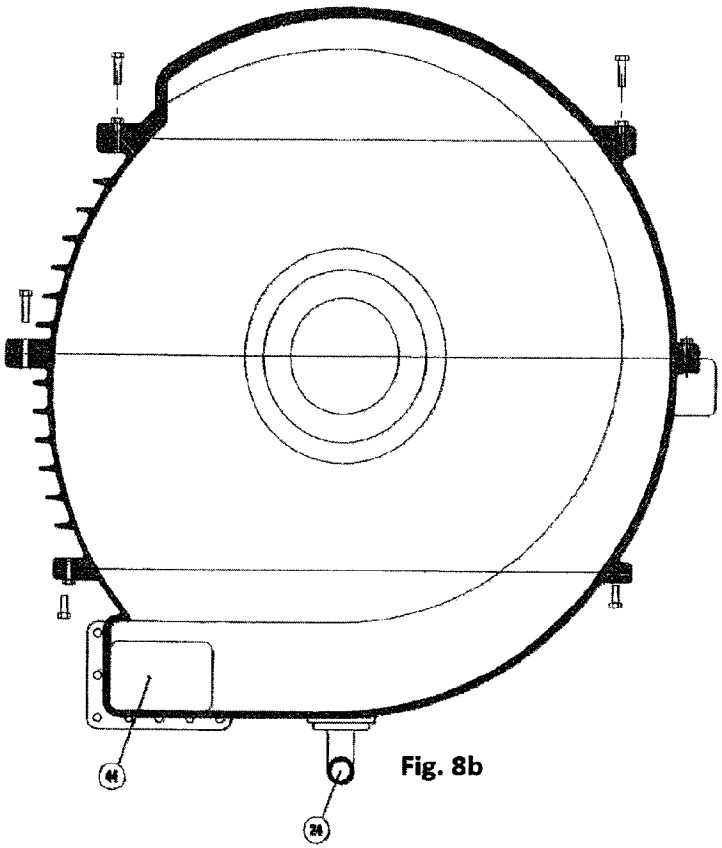
FIGS. 8*a*-8*b*—Case crosswise section—supercharger position
Figure 8A:
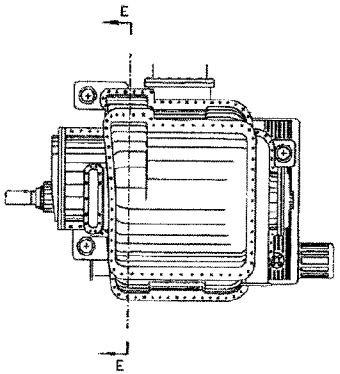
Figures 10A, 10B:
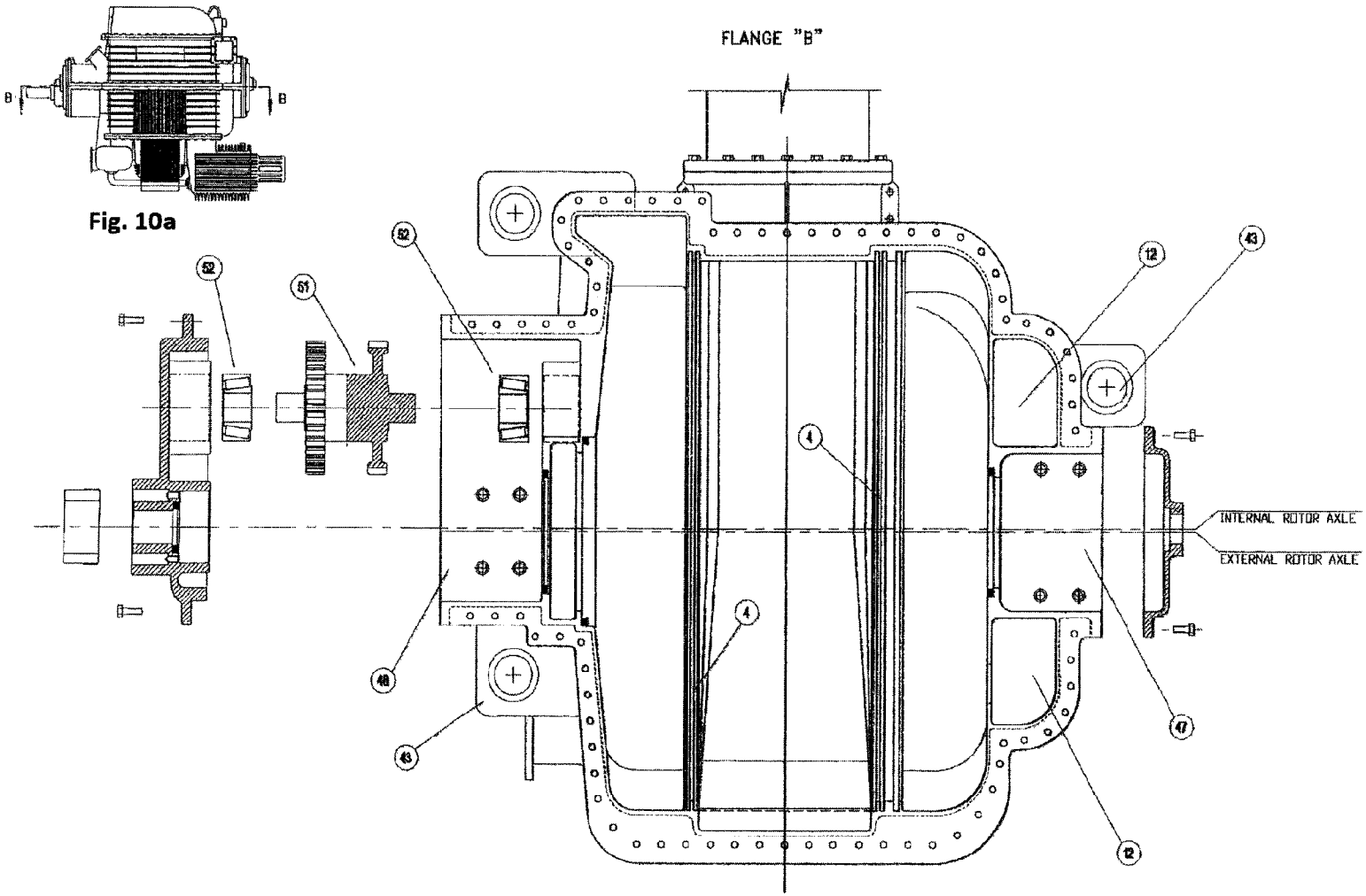
FIGS. 10*a*-10*b* Case—axial flange B
Figure 11B:
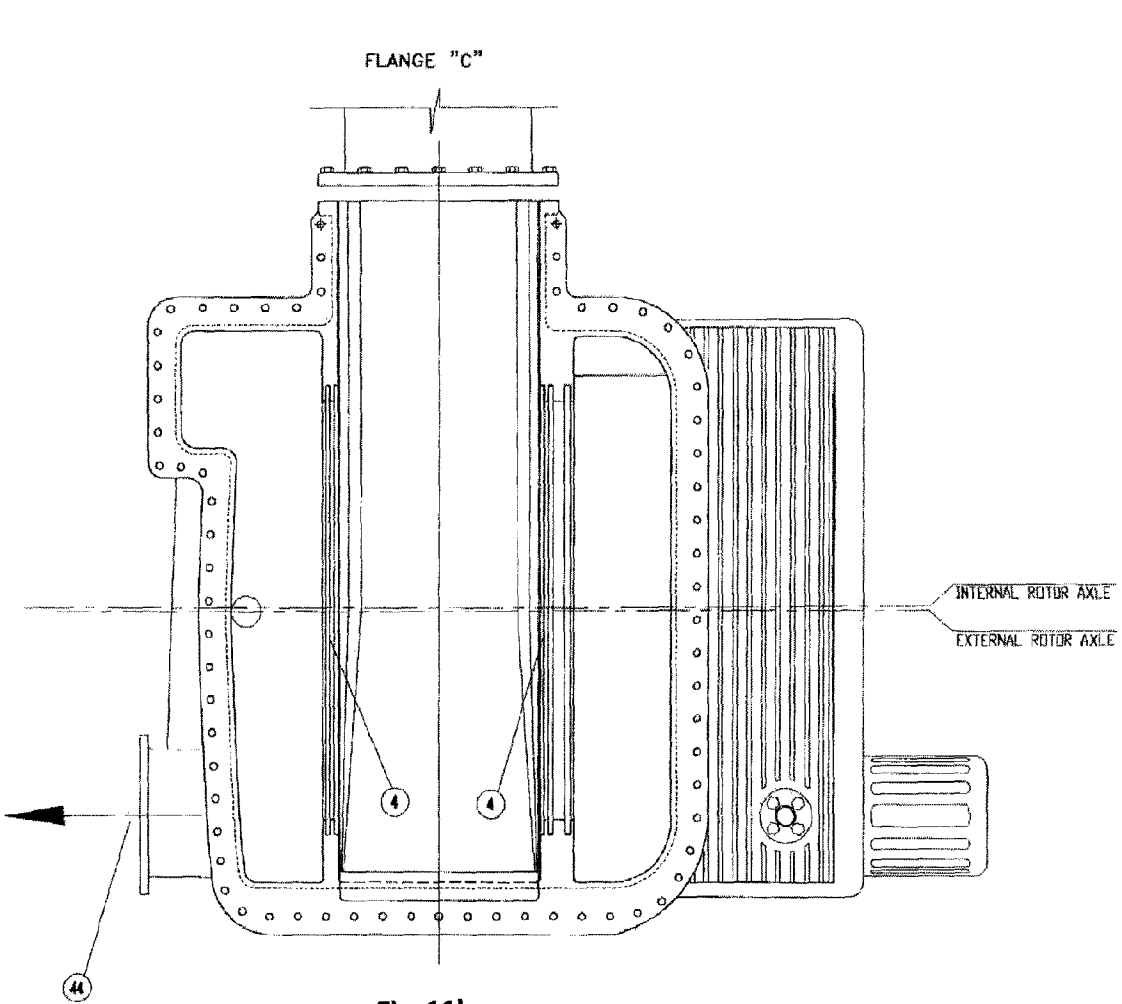
FIGS. 11*a*-11*b* Case—oil sump flange C
Figure 11A:
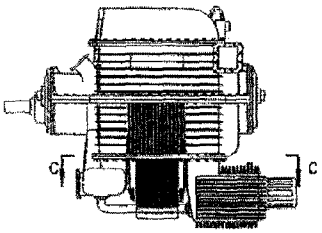

As shown in the plane view of FIGS. 10*a*-10*b* and vertical section of FIGS. 5*a*-5*b*, there are two boxes 47, 48 outside the engine. Looking the figure, one box 48 at the left end containing the rotor support 31 on the supercharger side and the rotor synchronization gear 51, the other box 47 at the right end containing the rotor support 20 at the timing system side.

Figures 12A, 12B, 12C:
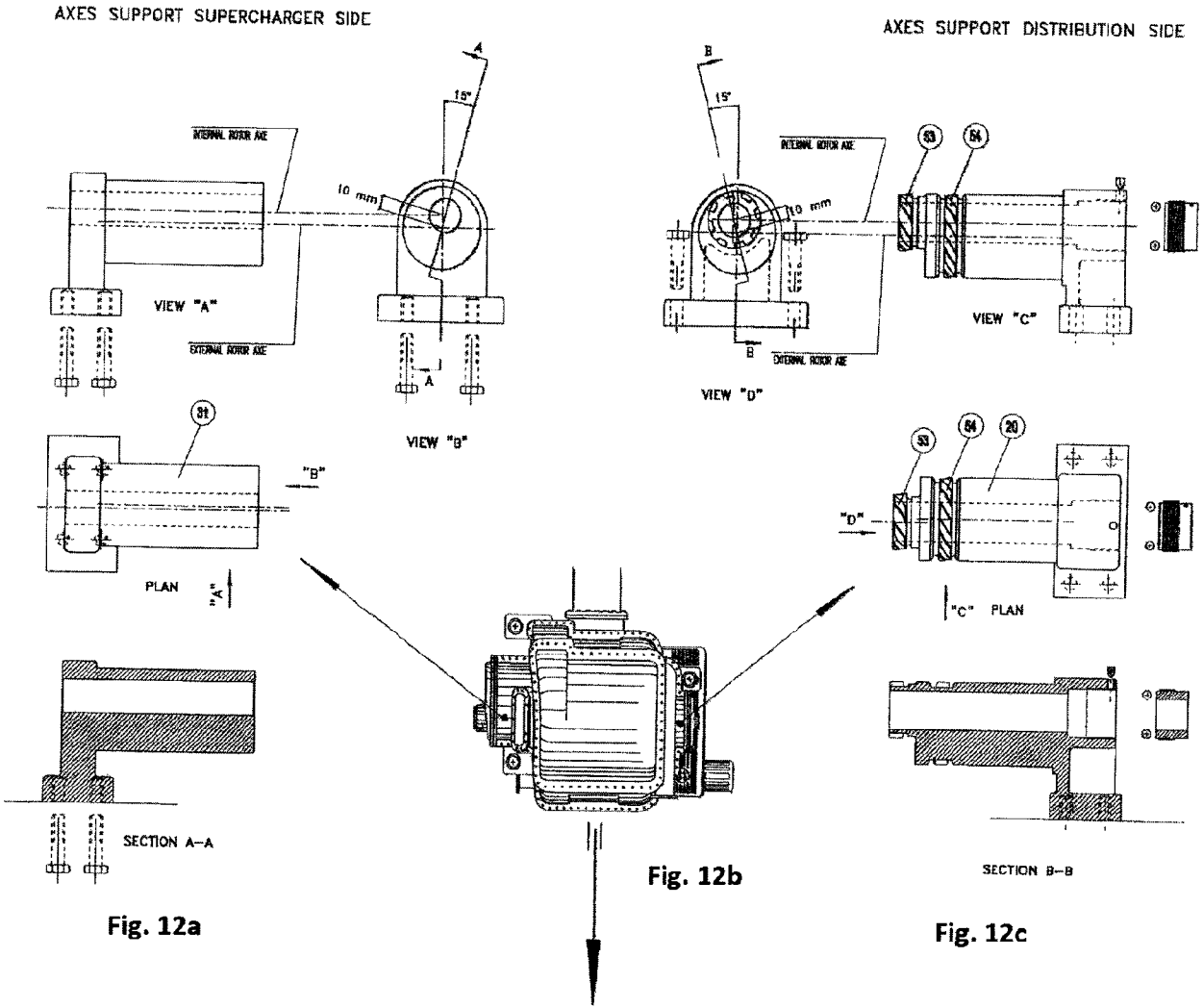
FIGS. 12*a*-12*c*—Engine rotor axes supports

The supports 20, 31 shown on FIGS. 12*a*-12*c* will also act as main bearings both for the external and internal rotors. While the external rotor is keyed on the outer surface of the support, the axis of the internal rotor shown on FIGS. 25*a*-25*f*, rotates in the longitudinal hole made in both supports.

As above mentioned, the circumference of the outer surface of the supports and the longitudinal hole have the centers laying on a plane inclined of 15 degrees relative to the vertical line (views B and D of FIGS. 12*a*-12*c*) and the distance between said centers for this embodiment is 10 mm as already mentioned.

On the timing system side support toothings are made with helical teeth constituting the two fixed gears through which the camshafts for moving the intake and discharge valves (4 timing spindles 10 of FIGS. 22*a*-22*c*) and two camshafts 11 for the injection pump (FIGS. 26*a*-26*b*) are driven.

External Rotor

The external rotor comprises two elements. The first element has the shape of a drum open at one side as shown in the perspective view of FIGS. 15*a*-15*c* and in the illustration of the two faces of sheets FIGS., in addition to the axial sections A-A and the cross section E-E on FIGS. 17*a*-17*b*.

On the closed side of this first element there are eight holes through which the intake valves 14 and discharge valves 42 are installed, as well as the fins 3 of the blower for the forced circulation of cooling air. On the peripheral surface of the drum one can see the outlets of the discharge nozzles 5 of the combustion gases and the rings of the sealing labyrinths 4. In the thickness of the drum body as shown in section E-E of FIGS. 17*a*-17*b*, the nozzles 5, the valves 41, 42, the spark plugs 55 and the cooling fins 7 are arranged. Two more wear resistant metal rings are arranged aside the combustion chambers. On said rings the compression rings of the planets and the satellites described later are rubbing.

The second element has the shape of a disk (FIGS. 21*a*-21*c*) and is mounted on the open side of the first element after having assembled the internal rotor. On said second element the timing system (FIGS. 22*a*-22*c*) and a set of blades (section A-A of FIGS. 21*a*-21*c*)are arranged, said blades having the function of forcing the internal circulation of cooling air in addition to a plurality of fins 23 removing heat from the area close to the combustion chambers.

On the first element the supercharger 2 is bolted, which is simply the group of intake manifolds 63 of the combusting air (FIGS. 23*a*-23*c*) cast on a support disk. In view of the radial arrangement of the manifolds and their spiral shape, they will operate as a true supercharger. The external rotor is practically a rotary head and inside it the intake valves 41 (FIGS. 18*a*-18*c*) and discharge valves 42 (FIGS. 19*a*-19*c*) are arranged and shown also on (FIGS. 14*a*-14*b*). Also on the external rotor one spark plug 55 for each combustion chamber is mounted (FIGS. 14*a*-14*b* and 17*a*-17*b* section E-E). The sparking current will be conveyed to the spark plug through a stretch of circular bar arranged in the labyrinths and shown with numeral 43 on FIGS. 13*a*-13*b*.

Internal Rotor

The internal rotor is shown in the perspective view of FIG. 24 together with its shaft and the separation elements of the crescent like combustion chambers (planet, satellite, planet guide and thrust spring). The faces of the rotor and the axial and cross sections can be seen on FIGS. 25*a*-25*f*. The separation elements of the chambers, namely the planets 38 and satellites 39, are shown in detailed in the exploded view of FIG. 27 and views and sections of sheets 28, 29 and 30.

On the planet like on the internal rotor, compression rings are mounted, warranting the tight seal between adjacent chambers operating at different strokes one from the other.

The planet is reciprocating on two guide sleeves 37 (see sections A-A and C-C of FIGS. 25*a*-25*f*) and a central spring 40 is pushing the planet outwards when the centrifugal force is absent at still engine, to keep the planet and satellite group always in contact with the external rotor.

The planet and the satellite are of vital importance for the operation of the engine. Indeed the satellite operating as a compression ring, in view of its shape and the centrifugal force, fits continuously on the inner surface of the external rotor rubbing on it without loosing contact with the planet, rotating in its housing around the axis M (FIGS. 30*a*-30*d*). The satellite is held in its position by a key (FIGS.27 and 29*a*-29*d*) leaving it free to oscillate only around the axis M.

In the internal rotor the injectors 60 (sections B-B and D-D of FIGS. 25*a*-25*f*) and the elements of the injection pump 62 (view B of FIGS. 25*a*-25*f*) are arranged, said pump being actuated by two camshafts 10, 11 (FIGS. 26*a*-26*c*) driven by the toothing 53, 54 of the rotor support 20 on the timing system side (FIGS. 12*a*-12*c*). FIG. 31 is an exploded perspective assembly view of the two rotors and of the elements connected thereto.

Friction And Seals

As mentioned hereinbefore, the two rotors mechanically coupled through the synchronizing gear arranged in the support box of the supercharger side (FIGS. 5*a*-5*b*, section C-C of FIGS. 6*a*-6*c* and FIGS. 10*a*-10*b*), are rotating synchronized and in the same direction.

The motion of the satellite on the inner surface of the external rotor is now described during an entire revolution of the engine starting from point X corresponding to the top dead center (FIGS. 14*a*-14*b*). In this position the axes of the two rotors and the axis of oscillation of the satellite are on the same plane and therefore the satellite is perfectly aligned with the planet.

At the first revolution quarter the planet satellite group reaches the point Y rubbing on the inner surface of the external rotor for ten millimeters counterclockwise. The satellite is no more aligned perfectly with the planet but is rotated to keep contact and tight seal on the inner surface of the external rotor, so that the plane containing the axis of the internal rotor and the satellite oscillation axis is laying at 10 mm from the plane where the axis of the external rotor is arranged.

The planet satellite group rubs clockwise on the external rotor until it returns to the starting position when the point W is reached after half revolution. The satellite is again perfectly aligned with the planet because the axes of the rotors and the satellite oscillation axis are again on the same plane and the planet satellite group is at the bottom dead center.

At three quarters of a revolution, the planet satellite group will be at the position J after having rubbed again clockwise for additional 10 mm. At this point the planet satellite group is in a mirror position relative to that taken when they were at the position Y, but also in this case the plane of the axis of the internal rotor and the satellite oscillation axis is 10 mm away from the plane containing the axis of the external rotor. The satellite to keep contact with the inner surface of the external rotor is again out of alignment with the planet and is rotated by an angle of opposite sign relative to the angle taken when it was at the position Y.

In the last quarter of revolution, the planet satellite group rubs again counterclockwise for additional 10 mm and returns exactly to the same position taken at the starting point, that is the position X.

The portions of the internal rotor in contact with the external rotor (compression rings and satellite) do not rub for the entire perimeter of the hypotrochoid chamber as happened in the Wankel engine, but are reciprocating from the starting point 10 mm clockwise and 10 mm counterclockwise so as to reduce wear to an amount which is even lower than the present reciprocating engine. The total rubbing action of the compression rings is at most equal to the double distance of the rotor axis. Indeed the compression rings closer to the center of the engine are rubbing some millimeters less the double distance of the rotor axis.

Engine Operation

The rotary engine of the present invention is a four stroke engine but while in the reciprocating engine each cylinder has only one positive stroke out of four, in this rotary engine there are two positive strokes out of four, as it is possible to see on sheet n°14 where the sequence of the valve positions is graphically illustrating the expansion and discharge strokes.

FIGS. 14*a*-14*b* is a cross sectional view of the engine looking at the supercharger, the rotation direction in this section is clockwise and at the center one can see the internal rotor (see also FIGS.24, 25*a*-25*f*), at its periphery the external rotor (see also FIGS. 15*a*-15*c*, 16*a*-16*c*, 17*a*-17*b*) and around the external rotor the case (see also FIGS. 6*a*-6*c*, 7*a*-7*b*, 8*a*-8*b* and 5 besides FIGS. 9*a*-9*b*, 10*a*-10*b* and 11*a*-11*b* for the flanges). The travel of one of the combustion chambers will now be described for instance starting from position A where the chamber will be shortly after starting the revolution having just passed the top dead center. The volume of the chamber is at minimum, its intake valve 41 and discharge valve 42 are both closed and the mixture just ignited and exploded is expanding generating a tangential thrust on the planet at position Y while the pressure on the opposite planet at position X is still null because the planet is fully retracted in its housing.

The rotor moves clockwise and when the chamber is at position B valves 41 and 42 will still be closed and the greater pressure on the planet now at position W relative to the pressure on planet at position Y generates still the torque that causes the rotors to rotate clockwise. With the chamber at intermediate position between B and C the discharge valve 42 begins to open and its opening is completed when the chamber fully reaches position C.

At this latter position, while the gas thrust on the planet now reaching a position close to J is finishing, the gases go out violently through the discharge valve 42 following a parabolic path obliged by the inner shape of the valve surface (see also section E-E of FIGS. 17*a*-17*b*) thus generating on said surface a tangential thrust in the same direction of rotor rotation as it happens on a turbine blade.

However the residual thermal energy is further exploited by expanding violently the still overheated gases in the nozzle 5 thus generating a further thrust and torque on its walls as it happens in the rocket engines.

The gas thrust in this phase is directly proportional to the peripheral velocity of the nozzle, that assuming a minimum number of revolutions between 7.000 and 10.000 will vary between 448 and 640 kilometers per hour (distance of the nozzles from the rotation center equal to 0.17 meters).

As a consequence while at low revolution rate the greater percentage of torque is generated during gas expansion in the chamber (minimum peripheral velocity of the nozzle) at high number of revolution the percentages are reversed.

The gas thrust in the discharge valve and the nozzle is terminated when the chamber will be again at the minimum volume at position D, that is when the rotor has practically completed a full revolution.

With the chamber at position D the discharge valve 42 will be almost completely closed again and the intake valve 41 that began to open shortly before, will now be fully open to introduce fresh air.

The presence of the two positive strokes out of four gives to the power curve of these engines a leveled shape, putting generally at disposal the same torque both at high and low revolution rate. It is to be noted that when discharge of overheated gases through the nozzle begins, said nozzle is aligned with the discharge manifold 25 and at the same time is facing backwards relative to the traveling direction of the vehicle so that there is a further forward thrust even if of small quantity, directly exerted on the vehicle.

Moreover the gases coming out in the final phase of the chamber discharge, leave the nozzle which is now in a vertical position, and therefore after having generated the torque on the rotor with their expansion in the nozzle, still produce a little thrust in the vehicle traveling direction because they are deviated to the discharge by the curve of the surface C.

While in the present reciprocating engines a too rich mixture produces only more consumption and engine overheating as well as smoke and unburnt gases, by a simple introduction of additional air into the discharge manifold 25, the complete combustion and maximum exploitation of the injected fuel is obtained.

In view of its construction, the rotary engine will always operate in a supercharged way because air sucked by manifold 1 (FIGS. 13*a*-13*b*) enters the engine around the axis of the external rotor and by centrifugal force is compressed on the intake valve (see numeral 2 on FIG. 13 and the supercharger on FIGS. 23*a*-23*c* and 31).

As a consequence, while in a reciprocating engine at a high number of revolution the torque is reduced in view of the lower volume of introduced air as a result of the shorter opening times of the intake valves, in the rotary engine of the invention this phenomenon is cancelled because at high number of revolutions the short opening time of the valves is balanced by the greater air pressure entering the intake valves. Therefore the volume of air introduced in the combustion chamber at high number of revolutions will be generally equal to the volume of air introduced at low number of revolutions. The efficiency of this rotary engine is also improved by the kind of valves adopted for intake and discharge, the possible discharge port will be greater than that obtainable with the reciprocating poppet valves and only one discharge valve as well as only one intake valve will be sufficient for each chamber, and intake and discharge will take place with full port and turbulence reduced to the minimum.

The axis of rotation of the intake and discharge valves is parallel to the rotor axis (FIGS. 18*a*-18*c* and 19*a*-19*c*) and their motion will not cause sensible unbalance on the rotors.

The intake valve (FIGS. 18*a*-18*c*) has an open bottom and is practically a hollow frustum cone with a longitudinal slot having width and length equal to the discharge port of the chamber. The discharge valve (FIGS. 19*a*-19*c*) has a closed bottom and in the portion in contact with the discharge port of the chamber has a longitudinal cavity with parabolic section.

The valves are actuated as a pair by a camshaft (that can be seen in detail on FIGS. 22*a*-22*c*) and three cams are acting on each valve, the central cam moving the valve in an axial direction to detach it from the contact and sealing surface of the rotor intake or discharge port (because of its frustum conical shape), while the couple of side cams acts an instant thereafter on the valve actuating member that with its movement will cause the valve to rotate to the open or closed position as said valve is no more stuck but free to rotate.

An instant after closure or opening of the valve, the central cam terminates its action and the valve pushed by the spring at its base, returns in contact with the discharge or intake port thus ensuring the tightness.

Cooling System

In view of the higher efficiency of this engine, the total heat to be dissipated during its operation will be lower than what necessary with the present reciprocating engines, and therefore an inner forced circulation (FIGS. 32*a*-32*b*) of air and the oil of the lubricating system as well as an outer forced circulation to the radiator will be sufficient to keep the temperature at acceptable values.

The cool oil coming back from the radiator will also take out heat from the lubricated hot points of the engine. The fins cast in the body of the external rotor (numeral 3 of FIGS. 13*a*-13*b*, FIGS. 16*a*-16*c*, 17*a*-17*b* and 32*a*-32*b*) forced air circulation inside the engine and to the radiator pushing the air out of the engine through the outlet U to recycle it through inlet E ( FIGS. 1, 2, 3 and 4). The inner circulation of air is free, while the outer circulation to the radiator is controlled by the engine thermostat.

Engine Position

The weights involved and the high number of revolutions will generate thrusts on the vehicle according to the laws governing the behavior of gyroscope.

In order to cause these forces to work to the advantage of driving stability, this engine will be installed on the vehicle with the rotor axis in a position crosswise the traveling direction (see FIG. 4) and the direction of rotation of the rotors will be only and exclusively that shown on FIG. 14*a*-14*b*.

As a result the vehicles provided with this engine only and exclusively at the bends, both left hand and right hand, will receive a stabilizing thrust in a direction opposite to the centrifugal force, causing the vehicle to be much stabler and more tractable for the driving motorist.

LIST OF REFERENCE NUMERALS

1) Combusting air intake port
2) Supercharger
3) Cooling air forced circulation fins
4) Labyrinth
5) Burnt gases discharge nozzle
6) Inner cooling circuit channels
7) External rotor cooling channels
8) Burnt gases discharge port
9) Timing system plate
10) Timing system shaft
11) Injection pump driving shaft
12) Radiator cooled air return room
13) Internal rotor shaft
14) Sealing ring
15) Support box plug
16) External rotor thrust bearing
17) Internal rotor thrust bearing
18) Internal rotor thrust bearing adjusting ring
19) Sealing ring
20) Timing system side support
21) Timing system side support fixing bolts
22) Lubrication oil sump
23) Cooling air forced circulation fins
24) Supercharger side lubrication oil recycle
25) Burnt gases discharge manifold
26) Thermal insulation blade
27) Insulating material
28) Oil suction ejector from cooling air radiator
29) External rotor thrust bearing
30) Supercharger side support fixing bolts
31) Supercharger side support
32) Internal rotor thrust bearing
33) Internal rotor shaft torque axis
34) Internal rotor thrust bearing adjusting ring
35) Internal rotor synchronization gear wheel
36) External rotor synchronization gear wheel
37) Planet guide sleeve
38) Planet
39) Satellite
40) Planet thrust spring
41) Intake valve
42) Discharge valve
43) Engine support
44) Cooling air outlet to radiator
45) Cooling air inlet from radiator
46) Spark plugs voltage feeding bar
47) Timing system side support box
48) Supercharger side support box and rotor synchronization gear wheel
49) First silencer
50) Second silencer
51) Rotor synchronization gear wheel
52) Bearing
53) Injection pump helical toothing
54) Timing system helical toothing
55) Spark plug
56) Valve rotation cams
57) Valve axial motion cam
58) Valve actuation camshaft
59) Internal rotor cooling fins
60) Injector
61) Compression ring housing
62) Injection pump
63) Combusting air intake port The invention claim is:

1. An internal combustion rotary engine comprising
an external rotor mounted for rotation about a first axis and
an internal rotor within the external rotor, mounted for rotation about a second axis offset from the first axis,
said rotors being mutually restrained and synchronized by synchronization gear wheels disposed in a common housing so that the rotors rotate in the same direction and at the same rotational speed on their respective axes,
wherein the external rotor contains a timing system, intake and discharge valves, and spark plugs, thereby functioning as a head.

2. The rotary engine according to claim 1, further comprising means to deviate gases to a tangential direction in the discharge valves, thereby generating a torque on the rotors so as to cause a second thrust level on the axis.

3. The rotary engine according to claim 2, further comprising a nozzle immediately downstream of each discharge valve, adapted to generate a further third level tangential thrust by rapid and additional internal expansion of overheated gases deviated in the discharge valve, so as to produce a further torque on the rotor system.

4. The rotary engine according to claim 1, wherein the internal rotor contains an injection pump and fuel injectors.

5. The rotary engine according to claim 1, wherein the intake and discharge valves are rotatable and undergo two motions, including a first small axial motion, adapted to unseat the valve and a second rotary motion adapted to alternately put the open side and the closed side in front of the intake and discharge ports.

6. The rotary engine according to claim 5, wherein the axis of rotation of the intake and discharge valves is parallel to the rotor axes.

7. The rotary engine according to claim 5, wherein the intake valve has a frustoconical hollow shape with an open bottom and has a longitudinal slot having a width and length equal to that of the discharge port of the chamber.

8. The rotary engine according the claim 7, wherein the discharge valve has a shape like the intake valve but with a closed bottom and, in a portion in contact with the discharge port of the combustion chamber, has a longitudinal cavity with a parabolic section.

9. The rotary engine according to claim 5, wherein said intake and discharge valves are actuated jointly by a camshaft, each valve being actuated by three cams, including a central cam moving the valve in an axial direction to unseat it from a contact and sealing surface of the rotor intake or discharge port, and a pair of side cams acting shortly thereafter on a valve driving member to cause the unseated valve to rotate in the opening and closing direction and immediately thereafter the central cam terminates its action and the valve is pushed by a return spring into contact with the discharge or intake port to ensure its tightness.

10. The rotary engine according to claim 1, further comprising a planet and a satellite member of a curved shape, fixed at the end of the planet and oscillating around its axis, adapted to act as a compression ring continuously fitting to the inner surface of the external rotor.

11. The rotary engine according to claim 10, further comprising a stationary seal between the internal and external rotors, said seal comprising compression rings mounted on the curved convex faces of the internal rotor and on the planet in addition to the satellite rubbing contact.

12. The rotary engine according to claim 1, wherein engine cooling is obtained through a forced circulation generated by a system of fins formed in the body of the external rotor, forcing air circulation inside the engine and to the radiator, as well as by cool lubricating oil returning from the radiator.

* * * * *